US011693351B2

(12) United States Patent
Takayama et al.

(10) Patent No.: US 11,693,351 B2
(45) Date of Patent: Jul. 4, 2023

(54) IMAGE FORMING APPARATUS CAPABLE OF REDUCING IMAGE DEFECTS CAUSED BY PAPER DUST

(71) Applicant: CANON KABUSHIKI KAISHA, Tokyo (JP)

(72) Inventors: Toshihiko Takayama, Kanagawa (JP); Shinsuke Kobayashi, Kanagawa (JP); Shuichi Tetsuno, Kanagawa (JP); Kazuhiro Funatani, Kanagawa (JP); Jun Hara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/675,629

(22) Filed: Feb. 18, 2022

(65) Prior Publication Data

US 2022/0269213 A1 Aug. 25, 2022

(30) Foreign Application Priority Data

Feb. 24, 2021 (JP) ..... 2021-027931

(51) Int. Cl.
*G03G 21/00* (2006.01)
*G03G 15/08* (2006.01)
*G03G 21/10* (2006.01)

(52) U.S. Cl.
CPC ..... *G03G 21/0035* (2013.01); *G03G 15/08* (2013.01); *G03G 21/0064* (2013.01); *G03G 21/10* (2013.01)

(58) Field of Classification Search
CPC ..... G03G 21/0005; G03G 21/0035; G03G 21/0064; G03G 21/0082; G03G 21/10
USPC ..... 399/98, 149, 150, 353
See application file for complete search history.

(56) References Cited

U.S. PATENT DOCUMENTS

2022/0269205 A1* 8/2022 Hara ..... G03G 15/065
2022/0269206 A1* 8/2022 Tetsuno et al. .... G03G 21/0005
2022/0413423 A1* 12/2022 Kobayashi ..... G03G 15/065

FOREIGN PATENT DOCUMENTS

JP H09325607 A 12/1997
JP 2006171247 A 6/2006
JP 2007065580 A 3/2007
JP 2008009148 A 1/2008

* cited by examiner

*Primary Examiner* — Ryan D Walsh
(74) *Attorney, Agent, or Firm* — Canon U.S.A., Inc. I.P. Division

(57) ABSTRACT

A driving unit is controlled so that a driving state where an image bearing member is driven with a first potential difference formed between a brush member and the image bearing member at a contact portion where the image bearing member is in contact with the brush member transitions to a stopped state where the image bearing member stops being driven with a second potential difference formed, the second potential difference having an absolute value less than that of the first potential difference.

27 Claims, 14 Drawing Sheets

FIRST COMPARATIVE EXAMPLE

FIRST EXEMPLARY EMBODIMENT

IMAGE FORMING APPARATUS CAPABLE OF REDUCING IMAGE DEFECTS CAUSED BY PAPER DUST

BACKGROUND OF THE DISCLOSURE

Field of the Disclosure

The present disclosure relates to image forming apparatuses, such as laser printers, copying machines, and facsimiles, that obtain recorded images by transferring toner images formed on image bearing members in electrophotographic methods to recording materials.

Description of the Related Art

There are known electrophotographic methods as image recording methods for use in image forming apparatuses such as printers and copying machines. One electrophotographic method uses an electrophotographic process of forming an electrostatic latent image on a photosensitive drum (hereinafter, may be referred to as a drum) with laser beams, developing the electrostatic latent image with a charged coloring material (hereinafter, referred to as toner) to form a developer image, and then transferring and fixing the developer image to a recording material for image formation. In recent years, there has been proposed cleanerless methods for the purpose of miniaturizing image forming apparatuses. One cleanerless method refers to a method where a developing unit cleans remaining toner, or developer, off the surface of a drum after a transfer step while developing to remove and collect the remaining toner from the drum and reuse it. As the cleanerless methods do not use a cleaning unit that is typically disposed with respect to the drum, paper dust on the drum can cause image defects during a transfer step to the recording material.

Japanese Patent Application Laid-Open No. 2007-65580 discusses a configuration where a fixed brush for collecting paper dust on a drum in a transfer step is disposed with respect to the drum rotationally downstream of a transfer portion and upstream of a charging portion.

However, with the configuration where the brush is in contact with the drum, paper dust collected and held in the brush can fall on the surface of the drum due to changes in speed in starting and stopping the rotational driving of the drum and partly go through the brush downstream, which can lead to image defects.

SUMMARY OF THE DISCLOSURE

The present disclosure provides for an image forming apparatus that can stably hold paper dust that has gathered in the brush due to sheet passage and which can help reduce image defects caused by the paper dust.

According to an aspect of the present disclosure, an image forming apparatus includes a rotatable image bearing member, a driving unit configured to drive the image bearing member to rotate, a charging member configured to charge a surface of the image bearing member at a charging portion where the charging member is opposed to the image bearing member, an exposure unit configured to expose the surface of the image bearing member charged by the charging member to form an electrostatic latent image on the surface of the image bearing member, a developing member configured to develop the electrostatic latent image into a developer image by supplying a developer charged to a normal polarity to the surface of the image bearing member, a transfer member configured to be in contact with the surface of the image bearing member to form a transfer portion and transfer the developer image from the surface of the image bearing member to a transfer material at the transfer portion, a brush member configured to form a contact portion downstream of the transfer portion and upstream of the charging portion in a rotation direction of the image bearing member and be in contact with the surface of the image bearing member at the contact portion, and a control unit configured to control the driving unit. The developing member is configured to, after the developer image formed on the surface of the image bearing member is transferred to the transfer material at the transfer portion, collect the developer remaining on the surface of the image bearing member. The control unit is configured to control the driving unit so that a driving state in which the image bearing member is driven with a first potential difference formed between the brush member and the image bearing member at the contact portion transitions to a stopped state where the image bearing member stops being driven with a second potential difference formed at the contact portion, the second potential difference having a same polarity as the first potential difference and an absolute value less than the absolute value of the first potential difference.

Further features of the present disclosure will become apparent from the following description of exemplary embodiments with reference to the attached drawings.

DESCRIPTION OF THE EMBODIMENTS

Some modes for carrying out the present disclosure will be exemplarily described in detail below based on exemplary embodiments with reference to the drawings. Dimensions, materials, shapes, and relative arrangements of components described in the exemplary embodiments are subject to appropriate changes depending on the configuration and the conditions of an apparatus to which the disclosure is applied. That is, the following exemplary embodiments are not intended to limit the scope of the present disclosure.

1. Image Forming Apparatus

Figure 1:
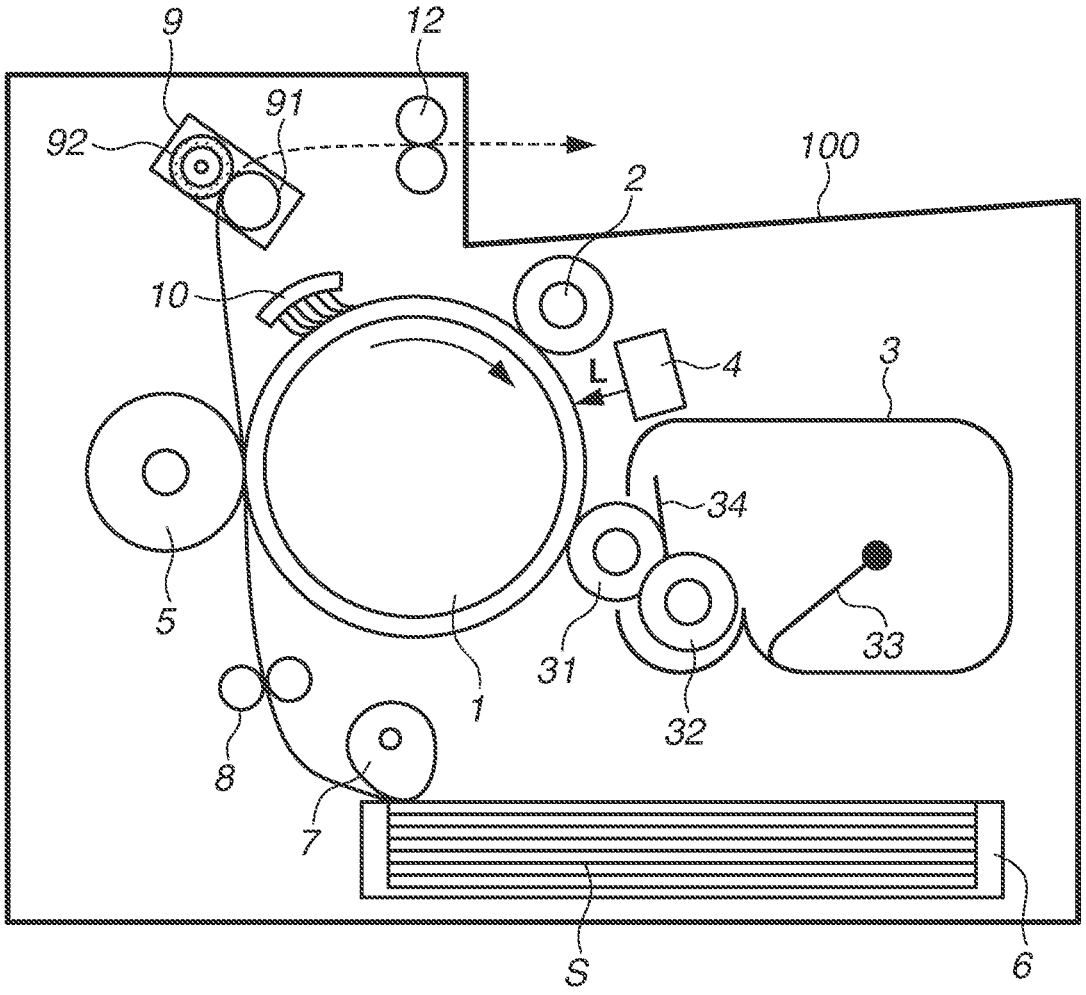
FIG. 1 is an explanatory diagram illustrating an image forming apparatus according to a first exemplary embodiment.

FIG. 1 illustrates a schematic configuration of an image forming apparatus 100 according to a first exemplary embodiment of the present disclosure.

The image forming apparatus 100 according to the first exemplary embodiment is a monochrome laser beam printer using a cleanerless contact charging method.

The image forming apparatus 100 according to the first exemplary embodiment includes a cylindrical photosensitive member serving as an image bearing member, i.e., a photosensitive drum 1. A charging roller 2 as a charging unit and a developing device 3 as a developing unit are located near the photosensitive drum 1. In FIG. 1, an exposure device 4 as an exposure unit is located between the charging roller 2 and the developing device 3 in the rotation direction of the photosensitive drum 1. A transfer roller 5 as a transfer unit is pressed against the photosensitive drum 1.

Figure 3:
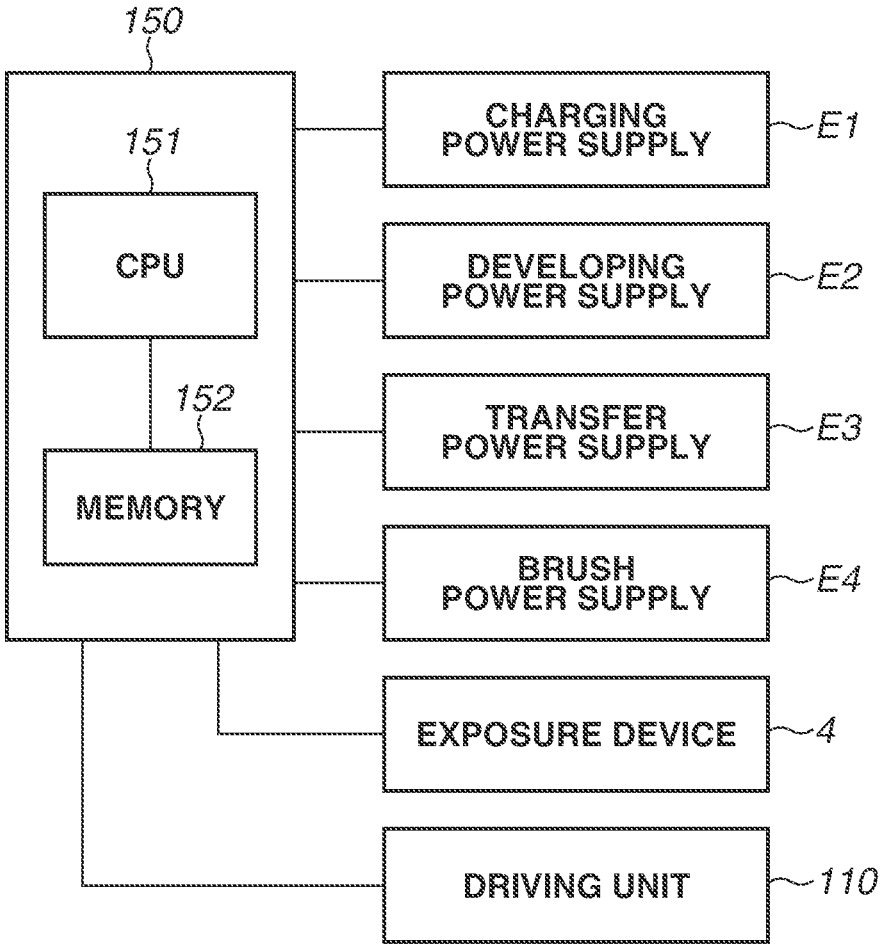
FIG. 3 is a control block diagram according to the first exemplary embodiment.

The photosensitive drum 1 according to the first exemplary embodiment is an organic photosensitive member of negative chargeability. The photosensitive drum 1 includes a photosensitive layer over a drum-shaped aluminum base. The photosensitive drum 1 is driven to rotate in the direction of the arrow in the diagram (clockwise) at a predetermined process speed by a driving motor that is a driving unit 110 (FIG. 3). In the first exemplary embodiment, the process speed is 140 mm/sec that is equivalent to the circumferential velocity (surface moving speed) of the photosensitive drum 1. The photosensitive drum 1 has an outer diameter of 24 mm.

The charging roller 2 as a charging member is in contact with the photosensitive drum 1 at a predetermined pressure contact force to form a charging portion. A charging power supply E1 (FIG. 3) as a charging voltage application unit applies a predetermined charging voltage to uniformly charge the surface of the photosensitive drum 1 to a predetermined potential. In the first exemplary embodiment, the surface of the photosensitive drum 1 is charged to a negative polarity by the charging roller 2. During the charging process, a predetermined charging voltage (charging bias) is applied to the charging roller 2 by the charging power supply E1. In the first exemplary embodiment, a direct-current voltage of negative polarity is applied to the charging roller 2 as the charging voltage during the charging process. For example, the charging voltage in the first exemplary embodiment is −1300 V. In the first exemplary embodiment, the surface of the photosensitive drum 1 is thereby uniformly charged to a dark area potential Vd of −700 V. More specifically, the charging roller 2 charges the surface of the photosensitive drum 1 with an electric discharge occurring in at least one of the small gaps formed between the charging roller 2 and the photosensitive drum 1 upstream and downstream of the contact portion with the photosensitive drum 1 in the rotation direction of the photosensitive drum 1. In the following description, the contact portion between the charging roller 2 and the photosensitive drum 1 in the rotation direction of the photosensitive drum 1 will be assumed to be the charging portion.

In the first exemplary embodiment, the exposure device 4 as the exposure unit is a laser scanner device. The exposure device 4 outputs laser light corresponding to image information input from an external apparatus such as a host computer, and scans and exposes the surface of the photosensitive drum 1. This exposure forms an electrostatic latent image (electrostatic image) corresponding to the image information on the surface of the photosensitive drum 1. In the present exemplary embodiment, the exposure by the exposure device 4 reduces the dark area potential Vd formed on the surface of the photosensitive drum 1 in the uniform charging process in absolute value into a light area potential V1 of −100 V. As employed herein, the position where the photosensitive drum 1 is exposed by the exposure device 4 in the rotation direction of the photosensitive drum 1 will be referred to as an exposure portion (exposure position). However, the exposure device 4 is not limited to a laser scanner device. In some embodiments, for example, a light-emitting diode (LED) array including a plurality of LEDs arranged along the longitudinal direction of the photosensitive drum 1 is used.

In the first exemplary embodiment, a contact developing method is used as the developing method. The developing device 3 includes a developing roller 31 as a developing member and a developer bearing member, a toner supply roller 32 serving as a developer supply unit, a developer accommodation chamber 33, which accommodates toner, and a developing blade 34. Toner supplied from the developer accommodation chamber 33 to the developing roller 31 by the toner supply roller 32 passes through a blade nip that is a contact portion between the developing roller 31 and the developing blade 34, and is thereby charged to a predetermined polarity. At the developing portion, the toner borne on the developing roller 31 moves from the developing roller 31 to the photosensitive drum 1 according to the electrostatic image. Here, the contact portion between the developing roller 31 and the photosensitive drum 1 in the rotation direction of the photosensitive drum 1 is referred to as the developing portion. In the first exemplary embodiment, the developing roller 31 is driven to rotate counterclockwise so that the photosensitive drum 1 and the developing roller 31 move in the forward direction in the developing portion. A driving motor that is a driving unit 110, which drives the developing roller 31, may be a main motor common with the driving unit 110 of the photosensitive drum 1. Respective different driving motors may be used to rotate the photosensitive drum 1 and the developing roller 31. During development, a predetermined developing voltage (developing bias) is applied to the developing roller 31 by a developing power supply E2 (FIG. 3) serving as a developing voltage application unit. In the first exemplary embodiment, a direct-current voltage of negative polarity is applied to the developing roller 31 as the developing voltage during development. The developing voltage is −380 V. In the first exemplary embodiment, toner charged to the same polarity as the charging polarity of the photosensitive drum 1 (in the first exemplary embodiment, negative polarity) adheres to exposed surfaces (image portions) that are image formation portions on the photosensitive drum 1 where the absolute potential value is reduced by the exposure after the uniform charging process. Such a developing method is referred to as a reversal developing method. In the first exemplary embodiment, the normal polarity that is the charging polarity of the toner during development is negative. In the first exemplary embodiment, a one-component nonmagnetic contact developing method is used. However, the present disclosure is not limited to such a mode, and a two-component nonmagnetic contact developing method, a contactless developing method, or a magnetic developing method may be used. The two-component nonmagnetic contact developing method is a method using a two-component developer including nonmagnetic toner and a magnetic carrier as the developer, and the developer (magnetic brush) borne on a developer bearing member is brought into contact with the photosensitive drum 1 for development. The contactless developing method is a method for developing an electrostatic latent image by flying toner to the photosensitive member from a developer bearing member opposed to the photosensitive member out of contact with the photosensitive member. The magnetic developing method is a method for performing development by magnetically bearing magnetic toner on a developer bearing member that includes a built-in magnet as a magnetic field generation unit and is opposed to the photosensitive member in or out of contact with the photosensitive member. In the first exemplary embodiment, toner used herein has a center average particle diameter of 6 μm and a negative normal charging polarity.

The transfer roller 5 serving as a transfer member can suitably include a sponge rubber or other elastic member made of polyurethane rubber, ethylene propylene diene monomer (EPDM), or nitryl butadiene rubber (NBR). The transfer roller 5 is pressed against the photosensitive drum 1 to form a transfer portion where the photosensitive drum 1 and the transfer roller 5 are in press contact with each other. During transfer, a predetermined transfer voltage (transfer bias) is applied to the transfer roller 5 by a transfer power supply E3 (FIG. 3) serving as a transfer voltage application unit. In the first exemplary embodiment, a direct-current voltage of opposite polarity (in the first exemplary embodiment, positive polarity) to the normal polarity of the toner is applied to the transfer roller 5 as the transfer voltage during transfer. In the first exemplary embodiment, the transfer voltage during transfer is +1000 V, for example.

A toner image is electrostatically transferred from the photosensitive drum 1 to a recording material S by the action of an electric field formed between the transfer roller 5 and the photosensitive drum 1.

A recording material (hereinafter, may be referred to as a transfer material) S stored in a cassette 6 is fed by a sheet feed unit 7 in synchronization with the timing when the toner image formed on the photosensitive drum 1 reaches the transfer portion. The transfer material S is passed between a registration roller pair 8 and conveyed to the transfer portion. The toner image formed on the photosensitive drum 1 is transferred onto the transfer material S by the transfer roller 5 to which the predetermined transfer voltage is applied by the transfer power supply E3.

The transfer material S with the toner image transferred on it is then conveyed to a fixing device 9. The fixing device 9 is a film heating type fixing device including a fixing film 91 and a pressure roller 92. The fixing film 91 includes a not-illustrated built-in fixing heater and a not-illustrated built-in thermistor for measuring the temperature of the fixing heater. The pressure roller 92 is pressed against the fixing film 91. The toner image is fixed to the transfer material S by heating and pressurization. The transfer material S is then passed between a discharge roller pair 12 and discharged out of the image forming apparatus 100.

Transfer residual toner remaining on the photosensitive drum 1 without being transferred to the transfer material S is removed in the following steps.

The transfer residual toner includes a mixture of toner charged to the positive polarity and toner charged to the negative polarity with an insufficient charge. The charging roller 2 charges the transfer residual toner to the negative polarity again using the discharge in the charging portion. As the photosensitive drum 1 rotates, the transfer residual toner charged to the negative polarity again by the charging roller 2 reaches the developing portion. The surface of the photosensitive drum 1 that reaches the developing portion includes an image forming portion where an electrostatic latent image is formed and a non-image forming portion where no electrostatic latent image is formed. The behavior of the transfer residual toner that reaches the developing portion will be described for the image forming portion and the non-image forming portion of the photosensitive drum 1 separately.

The transfer residual toner on the image forming portion of the photosensitive drum 1 is not transferred from the photosensitive drum 1 to the developing roller 31 at the developing portion. The transfer residual toner then moves to the transfer portion along with toner developed by the developing roller 31 and is transferred to the transfer material S for image formation.

Meanwhile, the transfer residual toner on the non-image forming portion of the photosensitive drum 1 is recharged to the negative potential, or normal potential, at the charging portion. The transfer residual toner transfers to the developing roller 31 at the developing portion because of the potential difference between the potential of the non-image forming portion of the photosensitive drum 1 and the developing voltage, and is collected into the developer accommodation chamber 33. The toner collected into the developer accommodation chamber 33 is used in image formation again.

2. Configuration of Brush Member

Next, a paper dust removal member according to the first exemplary embodiment will be described. As illustrated in FIG. 1, the image forming apparatus 100 according to the first exemplary embodiment includes a brush member 10 (collection member), which is a contact member serving as the paper dust removal member. In the first exemplary embodiment, the image forming apparatus 100 includes the brush member 10, which is in contact with the surface of the photosensitive drum 1 to form a brush contact portion (brush contact position) downstream of the transfer portion and upstream of the charging portion in the rotation direction of the photosensitive drum 1. Here, the contact portion between the brush member 10 and the photosensitive drum 1 in the rotation direction of the photosensitive drum 1 will be referred to as the brush contact portion (hereinafter, referred to as a contact portion).

Figure 2A:
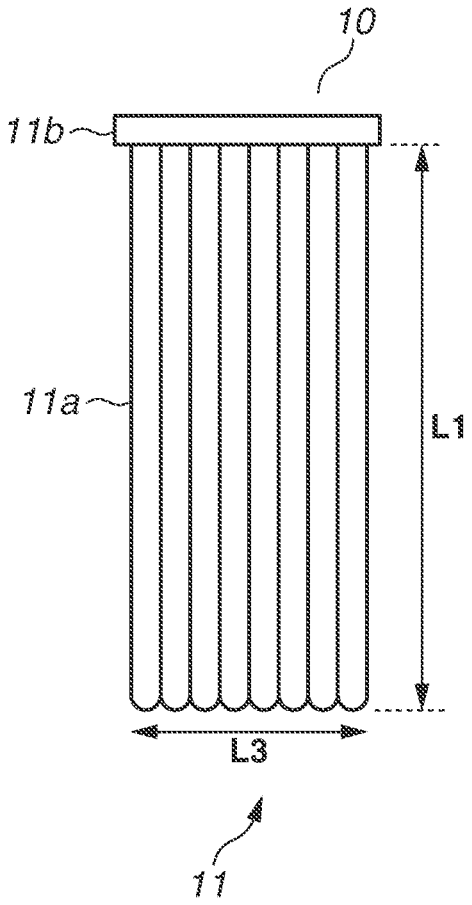
FIGS. 2A and 2B are schematic diagrams illustrating a brush member according to the first exemplary embodiment.
Figure 2B:
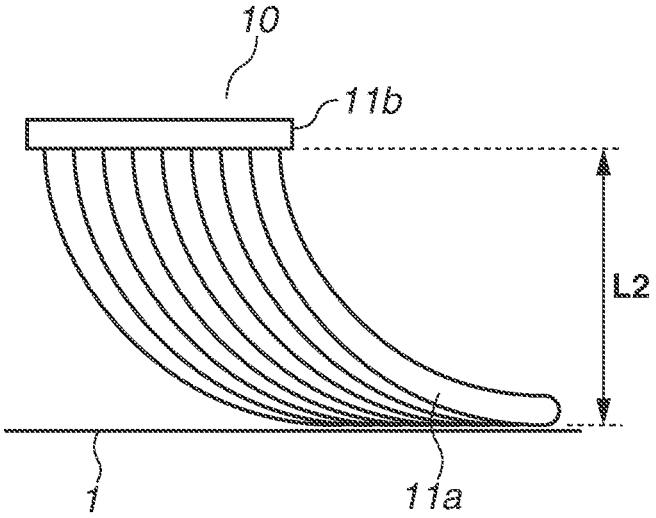

FIG. 2A is a schematic diagram illustrating the brush member 10 alone as seen along its longitudinal direction (substantially parallel to the direction of the rotation axis of the photosensitive drum 1). FIG. 2B is a schematic diagram illustrating the brush member 10 in contact with the photosensitive drum 1, seen along its longitudinal direction.

The brush member 10 includes a brush portion composed of a conductive fixed brush 11, which is located at a fixed position. As illustrated in FIGS. 2A and 2B, the brush member 10 includes conductive 6-nylon pile yarns 11*a*, which are a plurality of bristle members to slide over the surface of the photosensitive drum 1, and a base cloth 11*b* supporting the pile yarns (hereinafter, referred to as conductive yarns) 11*a*. As described above, the brush member 10 is located in contact with the photosensitive drum 1 downstream of the transfer portion and upstream of the charging portion in the moving direction (rotation direction) of the photosensitive drum 1.

The brush member 10 is disposed with its longitudinal direction substantially parallel to the direction of the rotation axis of the photosensitive drum 1. In some embodiments, aside from nylon, the conductive yarns 11*a* are made of materials such as rayon, acrylic fibers, and polyester.

As illustrated in FIG. 2A, the distance to the ends of the conductive yarns 11*a* exposed from the base cloth 11*b* with the brush member 10 alone, i.e., without external force to bend the conductive yarns 11*a*, will be denoted by L1. In the first exemplary embodiment, L1 is 6.5 mm. The base cloth 11*b* of the brush member 10 is fixed to a support member (not illustrated) located at a predetermined position of the image forming apparatus 100 by a fixing unit such as a two-sided adhesive tape so that the ends of the conductive yarns 11*a* interfere with the photosensitive drum 1. In the first exemplary embodiment, the clearance between the support member and the photosensitive drum 1 is fixed. The shortest distance from the base cloth 11*b* of the brush member 10 fixed to the support member to the photosensitive drum 1 will be denoted by L2. In the first exemplary embodiment, a difference between L2 and L1 will be defined as the amount of interference of the brush member 10 with the photosensitive drum 1. In the first exemplary embodiment, the amount of interference of the brush member 10 with the photosensitive drum 1 is 1 mm. In the first exemplary embodiment, as illustrated in FIG. 2A, a length L3 of the brush member 10 in the circumferential direction (hereinafter, referred to as a "transverse direction") of the photosensitive drum 1 with the brush member 10 alone is 5 mm. In the first exemplary embodiment, the brush member 10 has a longitudinal length of 216 mm. Such a configuration allows the brush member 10 to be in contact with the entire image forming area of the photosensitive drum 1 (area where a toner image can be formed) in the direction of the rotation axis of the photosensitive drum 1. In the first exemplary embodiment, the conductive yarns 11*a* have a thickness of 2 deniers and a density of 240 kF/inch$^2$ (kF/inch$^2$ is a unit of brush density, indicating the number of filaments per square inch). The brush member 10 is thus supported by the not-illustrated support member and located at a fixed position with respect to the photosensitive drum 1, and slides over the surface of the photosensitive drum 1 as the photosensitive drum 1 moves.

The brush member 10 traps (collects) matter such as paper dust transferred from the recording material S present on the photosensitive drum 1 at the transfer portion. The brush member 10 thus reduces the amount of paper dust moving to the charging portion and the developing portion downstream of the brush member 10 in the moving direction of the photosensitive drum 1.

In the first exemplary embodiment, the length L3 of the brush member 10 in the circumferential direction (hereinafter, referred to as a transverse direction) of the photosensitive drum 1 is set to 5 mm. However, this is not restrictive. For example, the length L3 may be changed as appropriate based on the life of the image forming apparatus 100 and the process cartridge. It will be understood that the greater the transverse length L of the brush member 10, the longer period of time the brush member 10 can trap paper dust.

In the first exemplary embodiment, the longitudinal length L1 of the brush member 10 is set to 216 mm. However, this is not restrictive. For example, the longitudinal length L1 may be changed as appropriate based on the maximum sheet passage width of the image forming apparatus 100.

In the first exemplary embodiment, the brush member 10 has a fineness of 220 T/96 F (meaning a bundle of 96 yarns having a thickness of 220 g per 10000 m). However, the fineness is desirably determined in consideration of the elusiveness of paper dust. The smaller the fineness of the brush member 10, the weaker the paper dust blocking power and the easier it is for paper dust to get through. The charging of the photosensitive drum 1 by the charging roller 2 can thus be hindered, causing image defects. If the fineness is too large, the brush member 10 is unable to collect toner or fine paper dust. This can cause density variations due to uneven toner adhesion in the longitudinal direction of the charging roller 2, and image defects due to defective charging at portions where paper dust adheres.

In the first exemplary embodiment, the brush member 10 has a density of 240 kF/inch$^2$. However, the density is desirably determined in consideration of toner passability and paper dust trappability. More specifically, if the brush member 10 has too high a density, the toner passability drops and the toner can get stuck. The stuck toner can be scattered, causing imperfection such as dirt in the image forming apparatus 100. If the brush member 10 has too low a density, the capability to capture paper dust drops.

In view of the paper dust trappability, the thickness and the density of the conductive yarns 11*a* are 1 to 6 deniers and 150 to 350 kF/inch$^2$, respectively. In view of long life, the transverse length of the brush member 10 is 3 mm or more.

A brush power supply E4 (FIG. 3) serving as a brush voltage application unit is connected to the brush member 10. A predetermined brush voltage (brush bias) is applied to the brush member 10 by the brush power supply E4 during image formation. In the first exemplary embodiment, a direct-current voltage of negative polarity is applied to the brush member 10 as the brush voltage during image formation. In the first exemplary embodiment, the brush voltage during image formation is −400 V, for example.

3. Image Output Operation

In the first exemplary embodiment, the image forming apparatus 100 performs an image output operation (job) that is a series of operations for forming an image on one or a plurality of recording materials S based on a start instruction from an external device (not illustrated) such as a personal computer. In general, a job includes an image forming step (print step), a pre-rotation step, a sheet interval step in forming images on a plurality of recording materials S, and a post-rotation step. The image forming step includes forming an electrostatic image on the photosensitive drum 1, developing the electrostatic image (formation of a toner image), transferring the toner image onto the recording medium, and fixing the toner image. This period, as a whole, is referred as image formation. More specifically, the timing of the image formation varies depending on the positions where the formation of the electrostatic image, the formation of the toner image, the transfer of the toner image, and the fixing of the toner image are performed. The pre-rotation step refers to a period when preparation operations preceding the image forming step are performed. The sheet interval step refers to a period corresponding to an interval between one recording material S and another during successive image formation. The post-rotation step refers to a period when conditioning operations (preparation operations) following the image forming step are performed. The periods other than during the image formation are during the non-image formation, which includes the foregoing pre-rotation step, sheet interval step, and post-processing step, and a pre-multi-rotation step where preparation operations upon power-on of the image forming apparatus 100 or upon recovery from a sleep state are performed.

4. Control Configuration

FIG. 3 is a schematic block diagram illustrating a control configuration of main parts of the image forming apparatus 100 according to the first exemplary embodiment. The image forming apparatus 100 includes a control unit 150. The control unit 150 includes a central processing unit (CPU) 151, a memory (storage element) 152 such as a read-only memory (ROM) and a random access memory (RAM), and an input/output unit (not illustrated). The CPU 151 serves as a calculation control unit that is a central element in performing calculation processing. The memory 152 serves as a storage unit. The input/output unit controls signal exchange with various elements connected to the control unit 150. The RAM stores sensor detection results and calculation results. The ROM stores control programs and predetermined data tables.

The control unit 150 controls the general operation of the image forming apparatus 100. The control unit 150 controls exchange of various electrical information signals and driving timing to run a predetermined image formation sequence. Various units of the image forming apparatus 100 are connected to the control unit 150. For example, in the first exemplary embodiment, the charging power supply E1, the developing power supply E2, the transfer power supply E3, the brush power supply E4, the exposure device 4, and the driving unit 110 are connected to the control unit 150.

5. Control According to Conventional Mode

Next, to facilitate understanding of control of various voltage potentials according to the present exemplary embodiment, control according to a conventional mode will be described with reference to FIG. 4.

Figure 4:
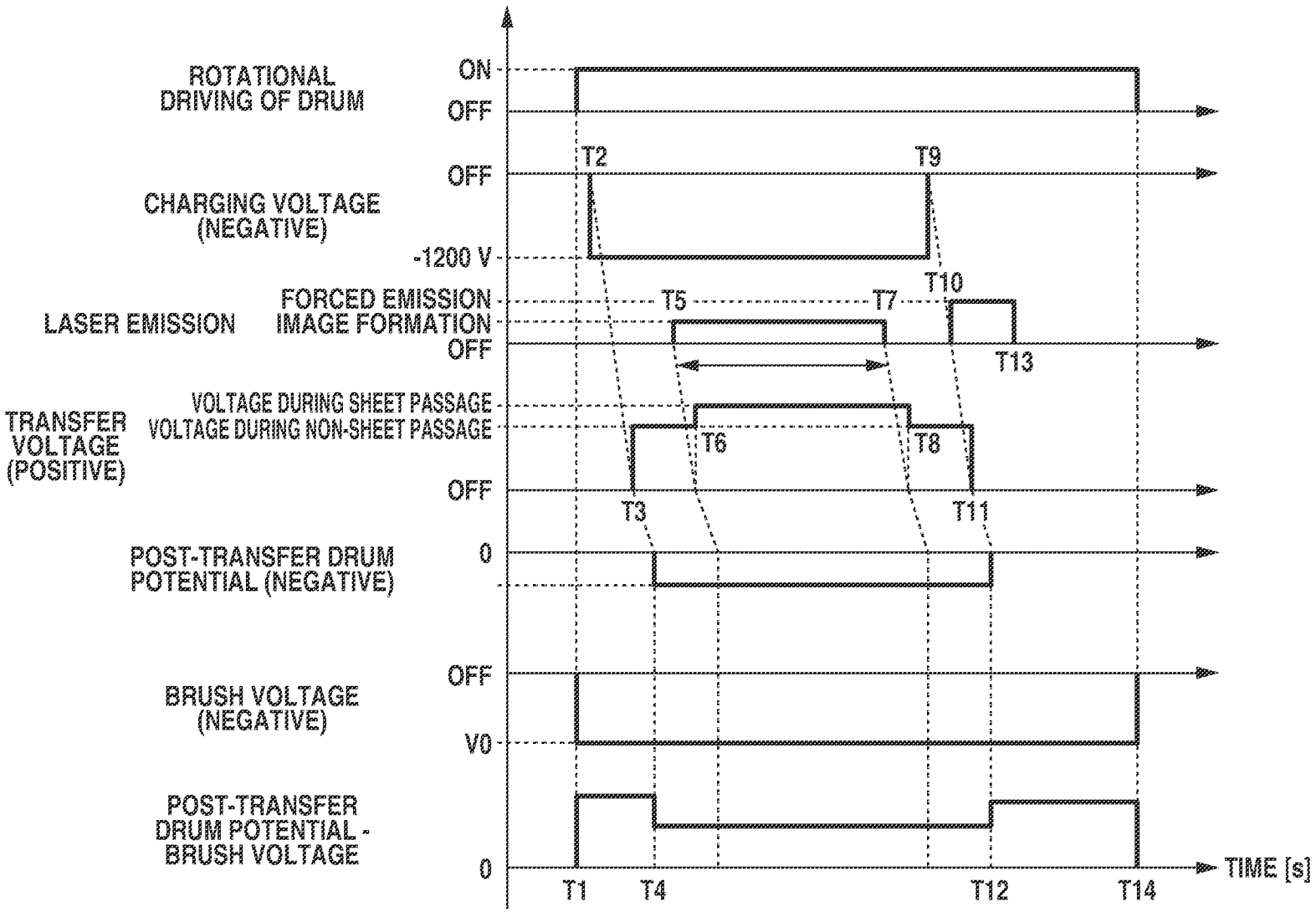
FIG. 4 is a diagram for describing control according to a first comparative example.

FIG. 4 is a timing chart illustrating control of a single print job operation by an image forming apparatus according to the conventional mode. FIG. 4 illustrates, in order from the top, rotational driving on and off of the photosensitive drum 1 by the driving unit 110, the charging voltage applied to the charging roller 2 from the charging power supply E1, and laser emission to the photosensitive drum 1 by the exposure device 4 (hereinafter, may also be referred to as a laser scanner device 4). FIG. 4 also illustrates the transfer voltage applied to the transfer roller 5 by the transfer power supply E3, the post-transfer surface potential of the photosensitive drum 1 at the contact portion given the transfer voltage, and the brush voltage applied to the brush member 10 by the brush power supply E4. FIG. 4 illustrates the difference between the surface potential of the photosensitive drum 1 at the contact portion and the brush voltage, calculated from the surface potential of the photosensitive drum 1 at the contact portion and the brush voltage, at the bottom.

FIG. 4 is a timing chart related to control performed in performing the image forming operation.

In FIG. 4, a print instruction is received before time T1, and the pre-rotation operation to be performed before the image forming operation is started. At time T1 during the pre-rotation operation, the photosensitive drum 1 starts to be driven to rotate and a voltage V0 is applied to the brush member 10. In the conventional mode, a voltage of negative polarity is applied as the brush voltage since a voltage of negative polarity is mainly applied as the brush voltage in the present exemplary embodiment to collect paper dust of positive polarity on the photosensitive drum 1 at the transfer portion.

At time T2, the charging voltage is applied to the charging roller 2. The charged area of the surface of the photosensitive drum 1 reaches the transfer portion at time T3, when the transfer voltage is applied and a resistance detection operation is performed. The transfer voltage applied here can be a voltage of the same polarity as and a smaller absolute value than +1000 V that is the transfer voltage applied during the image forming operation. In the conventional mode and the first exemplary embodiment, a voltage during non-sheet passage of +700 V is applied. At time T4, the surface of the photosensitive drum 1 where the post-transfer potential is formed reaches the contact portion. While the transfer voltage is changed between the period of sheet passage and the period of non-sheet passage, the values of the transfer voltage are set so that the same transfer current flows regardless of the presence or absence of the recording material S. The transfer voltage is thus controlled to provide substantially the same post-transfer potential at the contact portion during sheet passage and during non-sheet passage.

After the end of the resistance detection operation, the image forming operation is started. At time T5, an electrostatic latent image based on image information is formed on the surface of the photosensitive drum 1. For that purpose, the surface of the photosensitive drum 1 is exposed by the laser scanner device 4. The electrostatic latent image is thereby formed on the photosensitive drum 1. The electrostatic latent image is then developed into a developer image at the developing portion. To transfer the developer image to the recording material S at the transfer portion, a transfer voltage during sheet passage (voltage during sheet passage) is applied at time T6. The transfer voltage here is +1000 V. The image forming operation then ends and the exposure is turned off at time T7. The control then proceeds to the post-rotation operation. The surface of the photosensitive drum 1 where the exposure portion is formed at time T7 reaches the transfer portion at time T8, when the transfer voltage is switched to a voltage during non-sheet passage. In the first exemplary embodiment, the transfer voltage applied at time T8 is the same as the voltage during non-sheet passage applied at time T3. However, this is not restrictive.

At time T9, the charging voltage is turned off. The surface of the photosensitive drum 1 where the charged portion is formed at time T9 reaches the exposure portion at time T10, when the laser scanner device 4 makes forced emission to the surface of the photosensitive drum 1. This lowers the surface potential of the photosensitive drum 1 as much as possible. In FIG. 4, the surface potential of the photosensitive drum 1 is illustrated to be lowered to 0 V for simplicity of the description. The surface of the photosensitive drum 1 where the exposed portion is formed at the time of the forced emission reaches the transfer portion at time T11, when the transfer voltage is turned off. From time T12 on, the post-transfer potential formed at the contact portion is 0 V. At time T13, the forced emission ends. In the conventional mode, the post-transfer surface potential of the photosensitive drum 1 is low at time T14, when the rotational driving of the photosensitive drum 1 is stopped and the brush voltage is turned off as well. By contrast, the first exemplary embodiment is characterized in that a paper dust discharge prevention sequence of the brush member 10 is run after time T12. The conventional mode will hereinafter be referred to as a first comparative example.

6. Control According to Present Exemplary Embodiment

Figure 5:
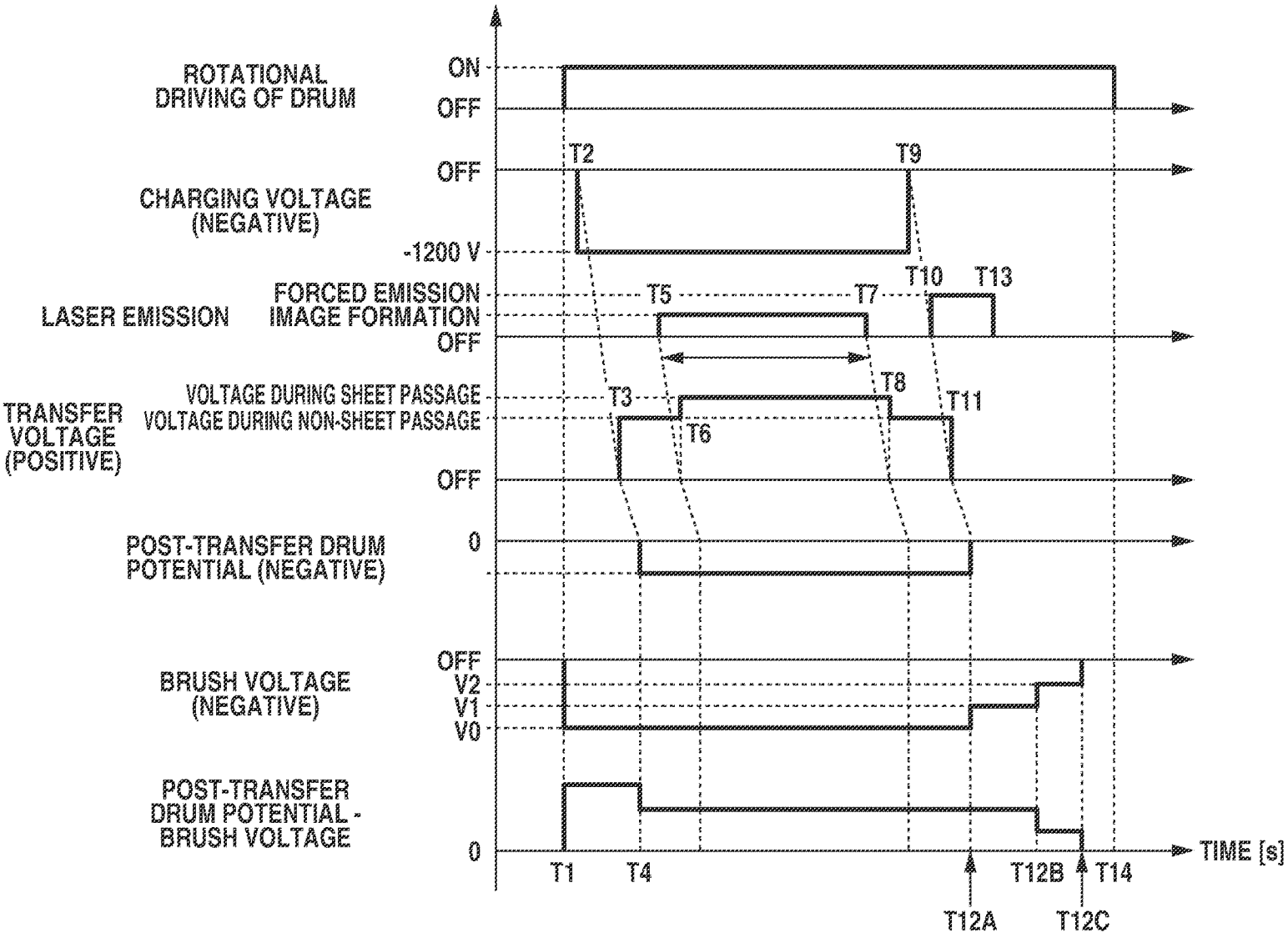
FIG. 5 is a diagram for describing control according to the first exemplary embodiment.

Next, control of various potentials according to the present exemplary embodiment will be described with reference to FIG. 5. FIG. 5 is a diagram illustrating the control of a single print job operation by the image forming apparatus 100 according to the present exemplary embodiment. The control from the start of the rotational driving of the photosensitive drum 1 to time T12 (in FIG. 5, T12A) is the same as in the foregoing first comparative example. The present exemplary embodiment is characterized in that when the post-transfer surface potential of the photosensitive drum 1 is lowered by the forced emission at time T12A, the brush voltage is lowered stepwise from V0 to V1 to V2 to off at times T12A, T12B, and T12C. Then, at time T14, the rotational driving of the photosensitive drum 1 is stopped. By such control, the electrostatic attractive force occurring between the photosensitive drum 1 and the brush member 10 can be gradually reduced in stopping the driving of the photosensitive drum 1. In the present exemplary embodiment, V0=−400 V, V1=−200 V, and V2=−100 V, whereas voltages in the range of −500 V to 0 V can be applied. The reason for |V0−V1|>|V1−V2| is that paper dust is more effectively held if a change in the voltage is smaller, i.e., a change in the electrostatic attractive force is smaller as the stop timing in stopping the driving of the photosensitive drum 1 is approaching. However, the orientation of the brush member 10 can be affected if the electrostatic attractive force is first drastically reduced while the photosensitive drum 1 is driven in a steady state. In some cases, a relationship |V0−V1|<|V1−V2| is therefore maintained while gradually increasing the voltage change in reducing the electrostatic attractive force. The relationship between V0, V1, and V2 may thus be adjusted as appropriate depending on the state of the brush member 10.

Next, the effect of the control according to the present exemplary embodiment on change in the orientation of the brush member 10 during the rotation and stop operations of the photosensitive drum 1 will be described.

Figure 6A:
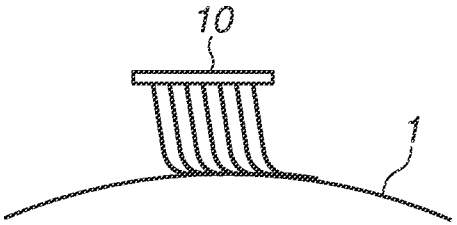
FIGS. 6A to 6C are diagrams for describing orientation of the brush member according to the first exemplary embodiment.

Initially, the orientation of the brush member 10 in the rotation direction of the photosensitive drum 1 caused by the rotational driving of the photosensitive drum 1 will be described with reference to FIGS. 6A to 6C. FIG. 6A is a diagram illustrating the orientation of the brush member 10 in a state where the photosensitive drum 1 is at rest. When the rotation of the photosensitive drum 1 is not rotating, no tangential force acts on the brush member 10 in the rotation direction of the photosensitive drum 1. The bristles thus do not lean much downstream.

Figure 6B:
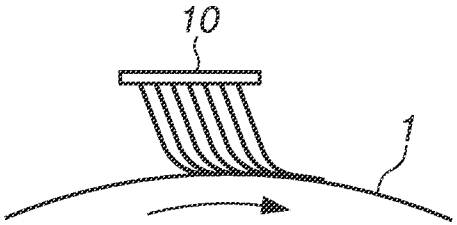

FIG. 6B is a diagram illustrating the orientation of the brush member 10 in a state where the photosensitive drum 1 is driven to rotate with no brush voltage applied. As the rotational driving of the photosensitive drum 1 causes a tangential force on the brush member 10 in the rotation direction of the photosensitive drum 1, the bristles lean more downstream in the rotation direction of the photosensitive drum 1 than those in FIG. 6A.

Figure 6C:
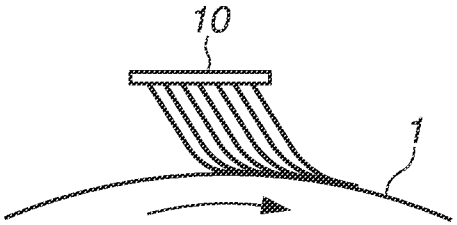

FIG. 6C is a diagram illustrating the orientation of the brush member 10 in a state where the photosensitive drum 1 is driven to rotate with the brush voltage applied. The application of the brush voltage to the brush member 10 generates an electrostatic attractive force due to the potential difference between the surface potential of the photosensitive drum 1 and the brush voltage. In FIG. 6C, the bristles thus lean greatly downstream in the rotation direction of the photosensitive drum 1 due to the rotational driving of the photosensitive drum 1 compared to FIG. 6B. The greater the potential difference between the brush voltage and the surface potential of the photosensitive drum 1, the higher the effect of the electrostatic attractive force.

In view of the foregoing tendency, a change in the orientation of the brush member 10 due to the control according to the first comparative example and the present exemplary embodiment will be described.

In the first comparative example, as illustrated in FIG. 4, the potential difference between the post-transfer surface potential of the photosensitive drum 1 and the brush voltage is substantially the same as the brush voltage from time T12 on until the rotation of the photosensitive drum 1 is stopped. The bristles thus lean greatly downstream as illustrated in FIG. 6C. In the first comparative example, the rotation of the photosensitive drum 1 is stopped and the brush voltage is turned off at the same time in such a state, and the state returns to that of FIG. 6A. Here, the orientation of the brush member 10 changes abruptly from as illustrated in FIG. 6C to FIG. 6A.

By contrast, in the present exemplary embodiment, the brush voltage is reduced stepwise and the potential difference between the surface potential of the photosensitive drum 1 and the brush voltage decreases gradually between time T12A and time T14 when the rotation of the photosensitive drum 1 is stopped. The orientation of the brush member 10 thus changes stepwise from as illustrated in FIG. 6C to FIG. 6B. The rotational driving of the photosensitive drum 1 is then stopped, and the orientation of the brush member 10 returns to that in FIG. 6A. Since the orientation of the brush member 10 changes here from as illustrated in FIG. 6B to FIG. 6A, the change in the orientation is smaller than that in the first comparative example.

Next, a result of a sheet passage test conducted to examine the effect of the present exemplary embodiment will be described.

The sheet passage test was conducted under the following condition. A white image was continuously printed on 100 sheets of recording materials S in an environment of 15° C. of temperature and 10% of relative humidity (low-temperature low-humidity environment), using Century Star paper (product name; manufactured by Century Pulp and Paper) as recording materials S. After the end of the printing, the rotation of the photosensitive drum 1 was once stopped. One white image was then printed again on a recording material S. Blot images in this recording material S were counted, and if the number of blots having a visually high impact with a size of 0.8 mm or more was 15 or more, paper dust trappability was evaluated as FAIL.

Table 1 illustrates the result of the foregoing sheet passage test conducted after the execution of the control according to the first comparative example and the first exemplary embodiment.

TABLE 1

| | Paper dust trappability | |
|---|---|---|
| | Number of blots (≥0.8 mm) | Evaluation |
| First comparative example | 40 | FAIL |
| First exemplary embodiment | 10 | PASS |

From the result of Table 1, it can be seen that the number of blots in the first comparative example exceeds 15, and that in the first exemplary embodiment falls below 15. That is, the number of blots in the first exemplary embodiment is clearly smaller than that in the first comparative example.

Figure 7A:
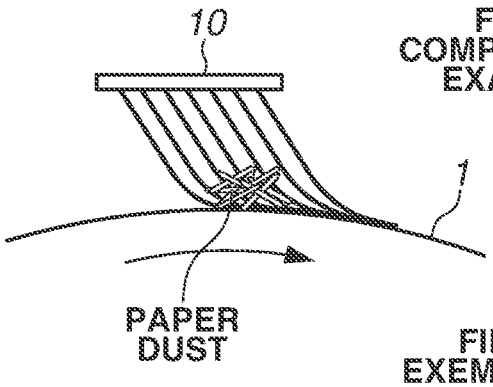
FIGS. 7A to 7C are diagrams for describing a change in the orientation of the brush member and a state of paper dust according to the first exemplary embodiment and the first comparative example.
Figure 7B:
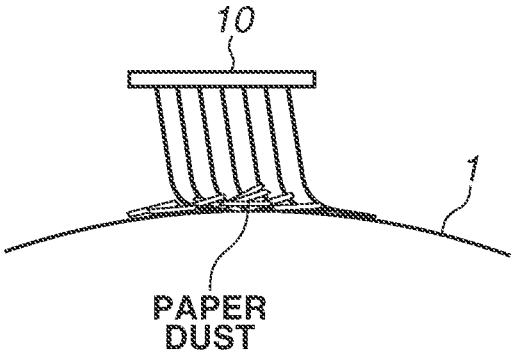
Figure 7C:
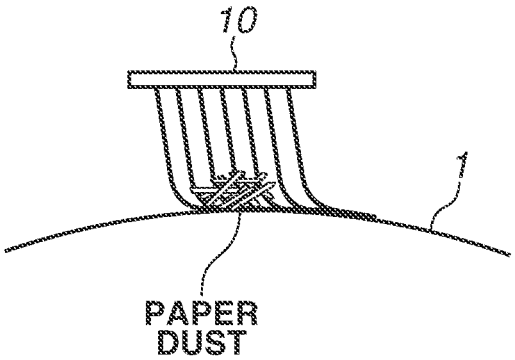

The behavior of the brush member 10 with collected paper dust will be described with reference to FIGS. 7A to 7C. In the foregoing sheet passage test, paper dust accumulates gradually in the brush member 10 and pieces of accumulated paper dust get entangled with one another to aggregate while a white image is continuously printed on 100 sheets. In the first comparative example and the first exemplary embodiment, the state of accumulation of paper dust on the brush member 10 is the same up to time T12 (T12A) in FIGS. 4 and 5 after the passing of the 100 sheets. FIG. 7A is a conceptual diagram illustrating the state of accumulation of paper dust on the brush member 10 at time T12 (T12A).

In the first comparative example, during the passage from time T12 to time T14 in FIG. 4, the foregoing abrupt change in the orientation of the brush member 10 causes the paper dust aggregate in the brush member 10 to be disintegrated. As a result, a large number of fine paper dust fibers get on the surface of photosensitive drum 1. FIG. 7B is a conceptual diagram illustrating such a state. When the printing of the next sheet starts at this state, a large number of paper dust fibers disintegrated in the brush member 10 and getting on the surface of the photosensitive drum 1 are likely to get through the contact portion. As a result, the number of blots caused by the paper dust getting on the surface of the photosensitive drum 1 increases in the printing operation of the immediately following sheet.

By contrast, in the first exemplary embodiment, the change in the orientation of the brush member 10 is smaller than that in the first comparative example as described above. The paper dust aggregate in the brush member 10 is thus less likely to disintegrate and fine paper dust fibers are less likely to get on the photosensitive drum 1. FIG. 7C is a conceptual diagram illustrating such a state. In the first exemplary embodiment, the paper dust aggregate in the brush member 10 remains held in the brush member 10 when the printing of the next sheet starts at this state. Not much paper dust therefore gets through the brush member 10 at the contact portion. As a result, the number of blots caused by the paper dust getting on the surface of the photosensitive drum 1 in the printing operation of the immediately following sheet is small.

As described above, a change in the orientation of the brush member 10 in stopping the rotational driving of the photosensitive drum 1 is reduced and the paper dust gathering in the brush member 10 is stably held by the control execution according to the first exemplary embodiment. This can reduce image defects caused by paper dust.

The first exemplary embodiment includes the following configuration. The image forming apparatus 100 includes the rotatable photosensitive drum 1, the driving unit 110, which drives the photosensitive drum 1 to rotate, and the charging roller 2, which charges the surface of the photosensitive drum 1 at the charging portion opposed to the photosensitive drum 1. The image forming apparatus 100 also includes the exposure device 4, which exposes the surface of the photosensitive drum 1 charged by the charging roller 2 to form an electrostatic latent image on the surface of the photosensitive drum 1, and the developing roller 31, which develops the electrostatic latent image into a developer image by suppling the developer charged to the normal polarity to the surface of the photosensitive drum 1. The image forming apparatus 100 further includes the transfer roller 5, which is in contact with the photosensitive drum 1 to form the transfer portion and transfers the developer image from the photosensitive drum 1 to a recording material S at the transfer portion. The image forming apparatus 100 further includes the brush member 10, which forms the contact portion downstream of the transfer portion and upstream of the charging portion in the rotation direction of the photosensitive drum 1 and is in contact with the photosensitive drum 1 at the contact portion, and the control unit 150, which controls the driving unit 110.

The developing roller 31 is configured to, after the developer image formed on the surface of the photosensitive drum 1 is transferred to the recording material S at the transfer portion, collect developer remaining on the surface of the photosensitive drum 1. The control unit 150 performs the following control while a driving state where the photosensitive drum 1 is driven transitions to a stopped state where the photosensitive drum 1 is stopped. The control unit 150 controls the driving unit 110 so that after a first potential difference is formed between the brush member 10 and the photosensitive drum 1 at the contact portion, the photosensitive drum 1 stops being driven with a second potential difference formed. The second potential difference has an absolute value less than the absolute value of the first potential difference.

The control unit 150 also controls the potential difference formed between the brush member 10 and the photosensitive drum 1 to change from the first potential difference to a third potential difference and from the third potential difference to the second potential difference, and stops driving the photosensitive drum 1. The absolute value of the third potential difference is a potential difference falling between the absolute value of the first potential difference and the absolute value of the second potential difference.

Such a configuration enables the image forming apparatus 100 to stably hold the paper dust gathering in the brush member 10 due to sheet passage and reduce image defects caused by the paper dust.

In the first exemplary embodiment, the brush voltage is turned off before the rotational driving of the photosensitive drum 1 is stopped. However, in some embodiments, the brush voltage is not turned off before the stopping of the rotational driving if the electrostatic attractive force at the brush voltage of V2 is sufficiently small and the change in the orientation is little affected.

In the first exemplary embodiment, the brush voltage is switched three times before the rotational driving of the photosensitive drum 1 is stopped. However, this is not restrictive. Switching the brush voltage at least once can be effective against the conventional mode. Additionally, the brush voltage may be switched more than three times.

In the first exemplary embodiment, the base of the photosensitive drum 1 is grounded. However, this is not restrictive. For example, the post-transfer surface potential of the photosensitive drum 1 can be controlled to cause the potential difference to change from the brush voltage stepwise by changes to the potential of the base being made using a high voltage element.

In the first exemplary embodiment, the effect on paper dust has been described. However, because a large change in the orientation of the brush member 10 can also scatter toner held by the brush member 10, the configuration is not limited to the brash member 10.

Next, another exemplary embodiment of the present disclosure will be described. A basic configuration and operation of an image forming apparatus according to a second exemplary embodiment are similar to those of the image forming apparatus 100 according to the first exemplary embodiment. The elements of the image forming apparatus according to the present exemplary embodiment that have identical or corresponding functions or configurations to those of the image forming apparatus 100 according to the first exemplary embodiment will therefore be denoted by the same reference numerals as with the image forming apparatus 100 according to the first exemplary embodiment. A detailed description thereof will be omitted.

1. Control According to Present Exemplary Embodiment

Figure 8:
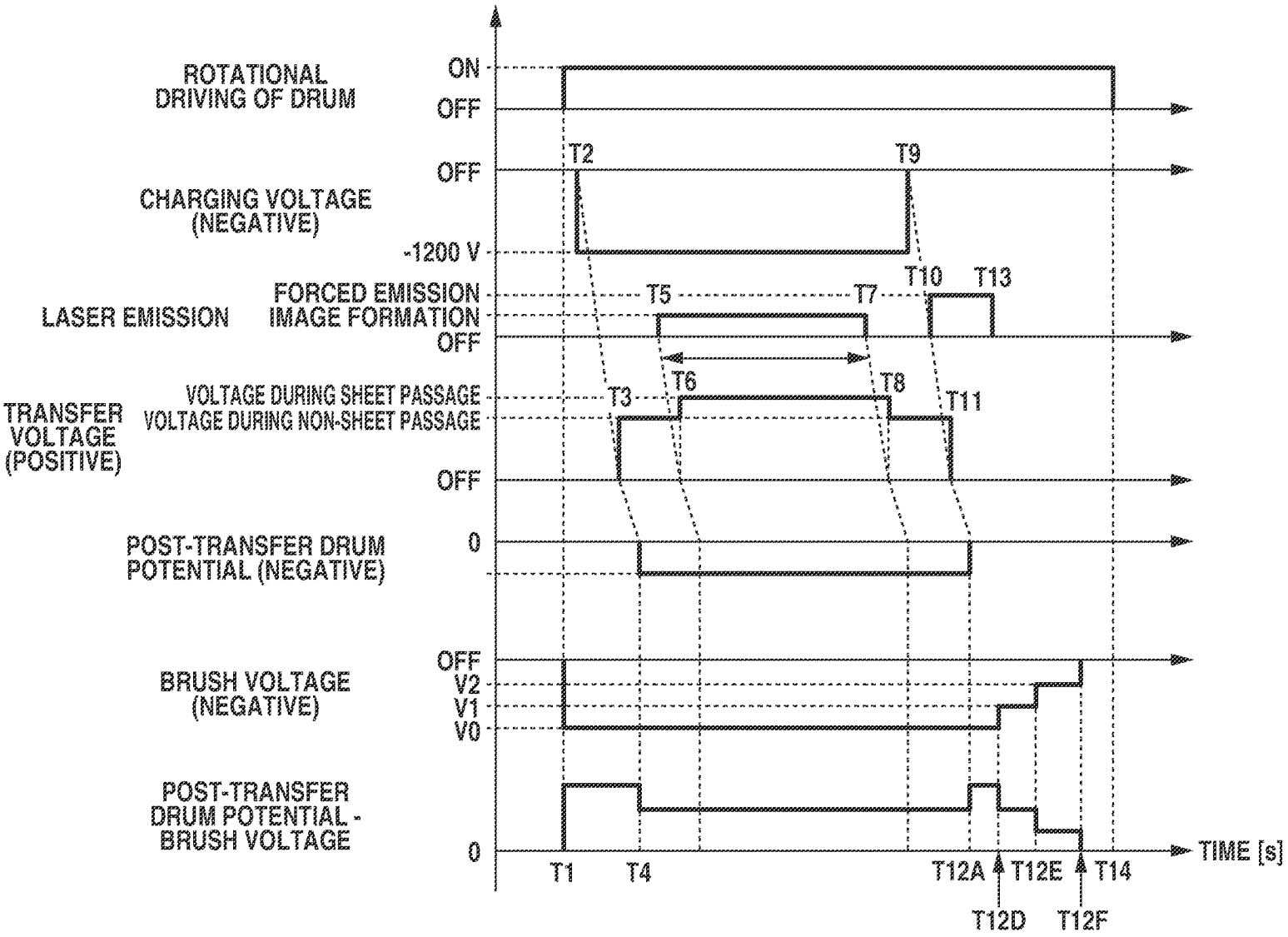
FIG. 8 is a diagram for describing control according to a second exemplary embodiment.

Next, control of various potentials according to the second exemplary embodiment will be described with reference to FIG. 8. FIG. 8 is a diagram illustrating the control of a single print job operation by the image forming apparatus 100 according to the second exemplary embodiment. The control is similar to that in the first exemplary embodiment from the start of the rotational driving of the photosensitive drum 1 to time T12A. In the second exemplary embodiment, the potential difference between the brush voltage and the surface potential of the photosensitive drum 1 is temporarily increased at time T12A when the post-transfer surface potential of the photosensitive drum 1 is lowered by the forced emission. The brush voltage is then reduced from V0 to V1 to V2 to off at times T12D, T12E, and T12F. At time T14, the rotational driving of the photosensitive drum 1 is stopped with the brush voltage off.

Table 2 illustrates a result of comparison between the result of a sheet passage test conducted in a similar manner to that in the first exemplary embodiment while executing the foregoing control of the second exemplary embodiment and that of the first exemplary embodiment.

TABLE 2

| | Paper dust trappability Number of blots (≥0.8 mm) |
|---|---|
| First exemplary embodiment | 10 |
| Second exemplary embodiment | 8 |

In comparison with the result of the first exemplary embodiment, the number of blots can be further reduced by the control execution of the second exemplary embodiment. The reason why the number of blots can be reduced is that the holding state of paper dust held in the brush member 10 can be more stabilized by the intentional increase of the potential difference between the brush member 10 and the photosensitive drum 1 once at time T12A. As the potential difference increases, the electrostatic attractive force between the brush member 10 and the photosensitive drum 1 temporarily increase. However, since the change in the orientation is largest at time T14 when the photosensitive drum 1 stops rotating, the effect of positively attracting the paper dust to the brush member 10 by the increase in the potential difference at time T12A is more significant than that of the increase of the electrostatic attractive force. In the second exemplary embodiment, a state where the brush member 10 is less likely to discharge paper dust to the surface of the photosensitive drum 1 is therefore considered to be successfully established in advance.

In the second exemplary embodiment, the potential difference formed between the brush member 10 and the photosensitive drum 1 is controlled to change from the first potential difference to a fourth potential difference and from the fourth potential difference to the second potential difference before the driving of the photosensitive drum 1 is stopped. The fourth potential difference is a potential difference greater than the second potential difference.

In comparison with the first exemplary embodiment, the paper dust deposited on the brush member 10 is thus stably held and the discharge of the paper dust due to a change in the orientation of the brush member 10 in rotating the photosensitive drum 1 can be further reduced by executing the control of the second exemplary embodiment.

Figure 9:
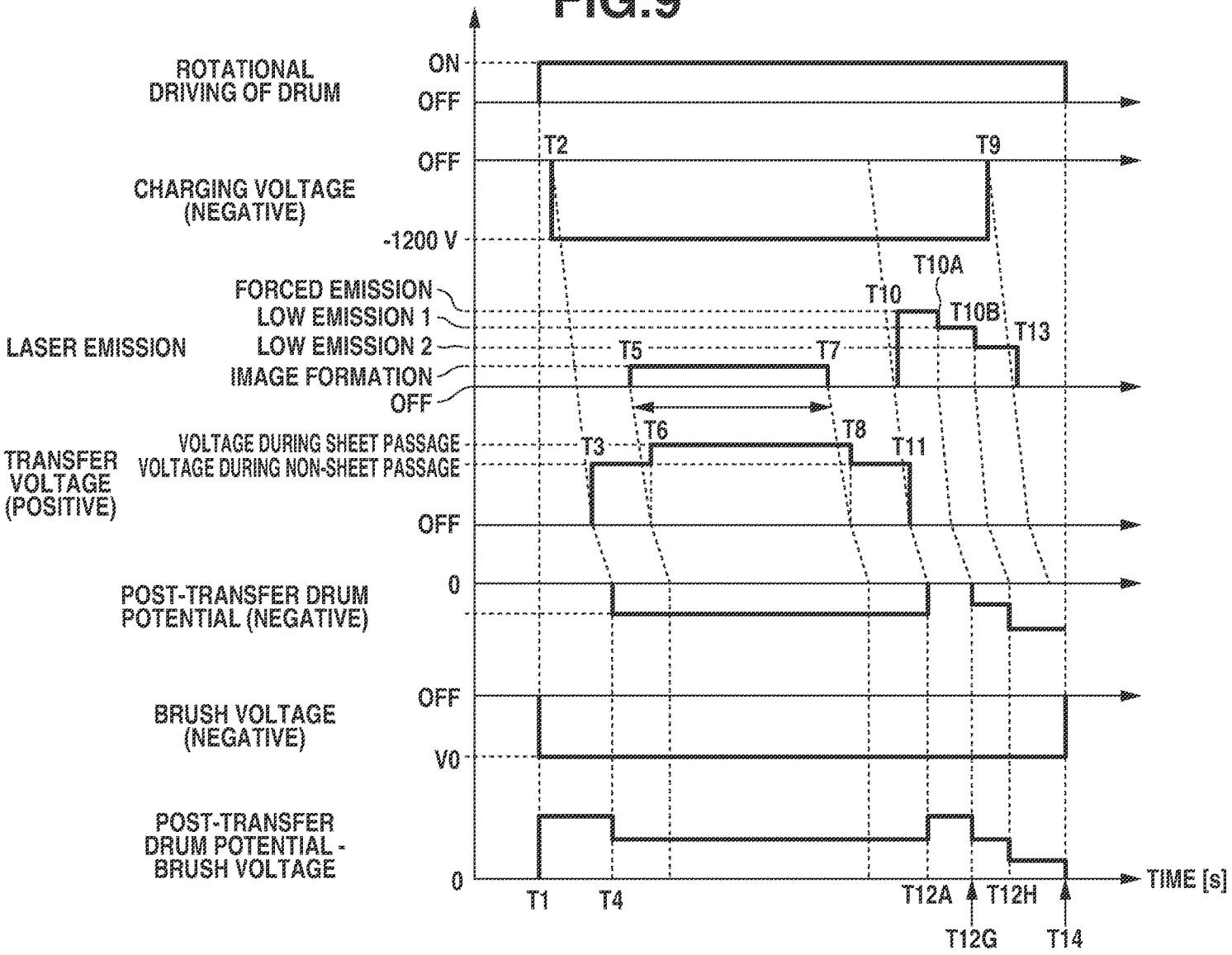
FIG. 9 is a diagram for describing another mode of control according to the second exemplary embodiment.

In the first and second exemplary embodiments, brush voltages in the range of −500 V to 0 V can be applied. If, however, one voltage value alone can be applied for reduced apparatus cost, the post-transfer surface potential of the photosensitive drum 1 may be changed stepwise. More specifically, the potential difference between the brush voltage and the post-transfer surface potential of the photosensitive drum 1 may be changed by changing the surface potential of the photosensitive drum 1 stepwise. FIG. 9 illustrates a case where the exposure intensity of the laser scanner device 4 is changed stepwise as an example of changing the post-transfer surface potential of the photosensitive drum 1. After the forced emission at time T10, exposure is performed under a condition for low emission 1 at time T10A and under a condition for low emission 2 at time T10B. The corresponding potential differences between the brush member 10 and the photosensitive drum 1 and the post-transfer potentials at the contact portion are illustrated at times T12G and T12H. The relationship between the exposure intensities illustrated in FIG. 9 represents a case where the exposure intensity of the forced emission is the highest, followed by those of low emission 1 and low emission 2 in order. Such a control enables the absolute value of the post-transfer surface potential of the photosensitive drum 1 to increase stepwise and the potential difference from the brush voltage to decrease stepwise. Thus, this provides similar effects to those of the first and second exemplary embodiments where the brush voltage is changed stepwise. In FIG. 9, the post-transfer surface potential of the photosensitive drum 1 is controlled by the change of the exposure intensity of the laser scanner device 4. However, this is not restrictive. For example, the post-transfer surface potential of the photosensitive drum 1 may be similarly controlled by a combination of the control of the charging voltage and that of the transfer voltage. It will be understood that similar effects can also be obtained by the reduction of the potential difference between the brush voltage and the post-transfer surface potential of the photosensitive drum 1 stepwise while both the brush voltage and the surface potential are changed.

Next, another exemplary embodiment of the present disclosure will be described. A basic configuration and operation of an image forming apparatus according to a third exemplary embodiment are similar to those of the image forming apparatus 100 according to the first exemplary embodiment. The elements of the image forming apparatus according to the third exemplary embodiment that have similar or corresponding functions or configurations to those of the image forming apparatus 100 according to the first exemplary embodiment will therefore be denoted by the same reference numerals as with the image forming apparatus 100 according to the first exemplary embodiment. A detailed description thereof will be omitted.

1. Control According to Present Exemplary Embodiment

Figure 10:
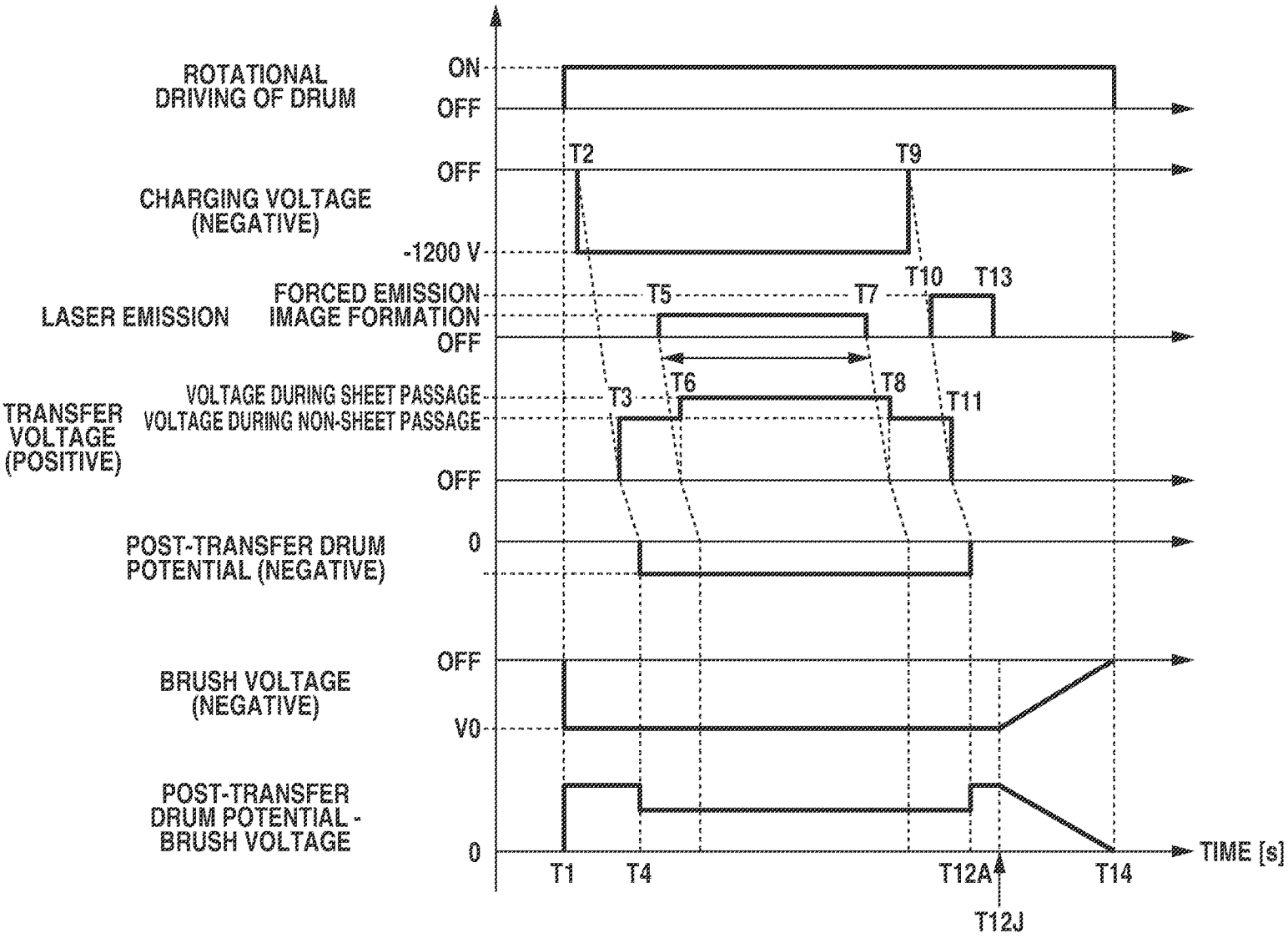
FIG. 10 is a diagram for describing control according to a third exemplary embodiment.

Next, control of various potentials according to the third exemplary embodiment will be described with reference to FIG. 10. FIG. 10 is a diagram illustrating the control of a single print job operation by the image forming apparatus 100 according to the third exemplary embodiment. The control is similar to those in the first and second exemplary embodiments from the start of the rotational driving of the photosensitive drum 1 to time T12A.

In the third exemplary embodiment, the brush voltage is continuously reduced from V0 to 0 V (off) from time T12J on after the post-transfer surface potential of the photosensitive drum 1 is lowered by the forced emission. The rotational driving of the photosensitive drum 1 is then stopped.

Table 3 illustrates a result of comparison between the result of a sheet passage test conducted in a similar manner to that in the first exemplary embodiment while performing the foregoing control of the third exemplary embodiment and that of the first exemplary embodiment.

TABLE 3

| | Paper dust trappability Number of blots (≥0.8 mm) |
|---|---|
| First exemplary embodiment | 10 |
| Third exemplary embodiment | 4 |

In comparison with the first exemplary embodiment, the number of blots can be further reduced by the control execution of the third exemplary embodiment. One reason why the number of blots can be reduced is that the change in the orientation of the brush member 10 from T12J on (FIG. 6C to FIG. 6B) is milder when the brush voltage is continuously reduced as in the third exemplary embodiment than that when the brush voltage is reduced stepwise. The paper dust aggregate in the brush member 10 is considered to be less likely to disintegrate.

In comparison with the first exemplary embodiment, the change in the orientation of the brush member 10 in rotating the photosensitive drum 1 can thus be further reduced, allowing the paper dust gathering in the brush member 10 to be stably held by the control execution of the third exemplary embodiment.

Next, another exemplary embodiment of the present disclosure will be described. A basic configuration and operation of an image forming apparatus according to a fourth exemplary embodiment are similar to those of the image forming apparatus 100 according to the first exemplary embodiment. The elements of the image forming apparatus according to the fourth exemplary embodiment that have similar or corresponding functions or configurations to those of the image forming apparatus 100 according to the first exemplary embodiment will therefore be denoted by the same reference numerals as with the image forming apparatus 100 according to the first exemplary embodiment. A detailed description thereof will be omitted.

The fourth exemplary embodiment is characterized by performing control in consideration of the discharge of toner on the brush member 10. Specifically, a brush voltage of the opposite polarity to that of the brush voltage applied during the image forming operation is applied during the post-rotation.

Figure 11:
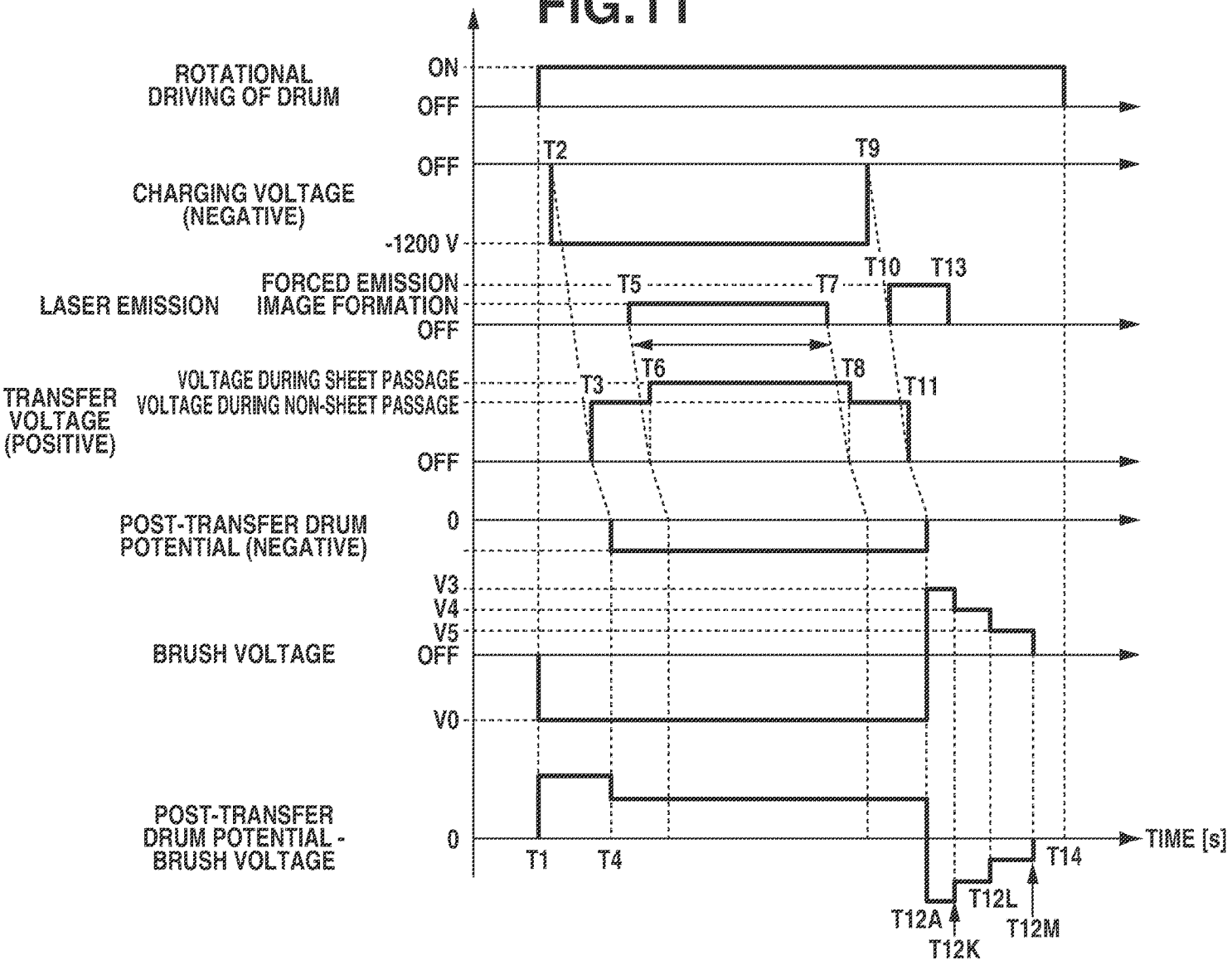
FIG. 11 is a diagram for describing control according to a fourth exemplary embodiment.

FIG. 11 is a diagram illustrating the control of a single print job operation by the image forming apparatus 100 according to the fourth exemplary embodiment. The control is similar to those in the first, second, and third exemplary embodiments from the start of the rotational driving of the photosensitive drum 1 to time T12A. In the fourth exemplary embodiment, the brush voltage is switched from a voltage of negative polarity to a voltage of positive polarity at time T12A of FIG. 11. The brush voltage is then switched to lower voltages of positive polarity stepwise and turned off at times T12K, T12L, and T12M, respectively. The rotational driving of the photosensitive drum 1 is then stopped at time T14.

In comparison with the first exemplary embodiment, the toner discharge performance can be improved by the control execution according to the fourth exemplary embodiment. One reason why the toner discharge performance can be improved is that the switching of the brush voltage to the voltage of the opposite polarity at time T12A enables accumulated toner of the opposite polarity during the image forming operation to be discharged during the post-rotation. Moreover, the changes in the orientation of the brush member 10 are similar to those in the first exemplary embodiment as the brush voltage is switched stepwise.

In comparison with the first exemplary embodiment, the changes in the orientation of the brush member 10 while the photosensitive drum 1 is rotating can be maintained and the toner can be effectively discharged from the brush member 10 by the control execution of the fourth exemplary embodiment.

In the fourth exemplary embodiment, the stepwise switching of the brush voltage may be controlled as with the configurations of the first and second exemplary embodiments. Specifically, in FIG. 11, the brush voltage is switched from −400 V to +400 V at time T12A, and then to +200 V at time T12K, to +100 V at time T12L, and to 0 V at time T12M. The values of the brush voltage are not limited to the foregoing.

Next, another exemplary embodiment of the present disclosure will be described. A basic configuration and operation of an image forming apparatus according to a fifth exemplary embodiment are similar to those of the image forming apparatus 100 according to the first exemplary embodiment. The elements of the image forming apparatus according to the fifth exemplary embodiment that have similar or corresponding functions or configurations to those of the image forming apparatus 100 according to the first exemplary embodiment will therefore be denoted by the same reference numerals as with the image forming apparatus 100 according to the first exemplary embodiment. A detailed description thereof will be omitted.

In the first, second, third, and fourth exemplary embodiments, the controls during the driving stop operation accompanying a typical printing operation have been described. In the fifth exemplary embodiment, control will be described that enables a similar reduction of the discharge of paper dust from the brush member 10 to the surface of the photosensitive drum 1 in starting driving.

1. Control According to Present Exemplary Embodiment

Figure 12:
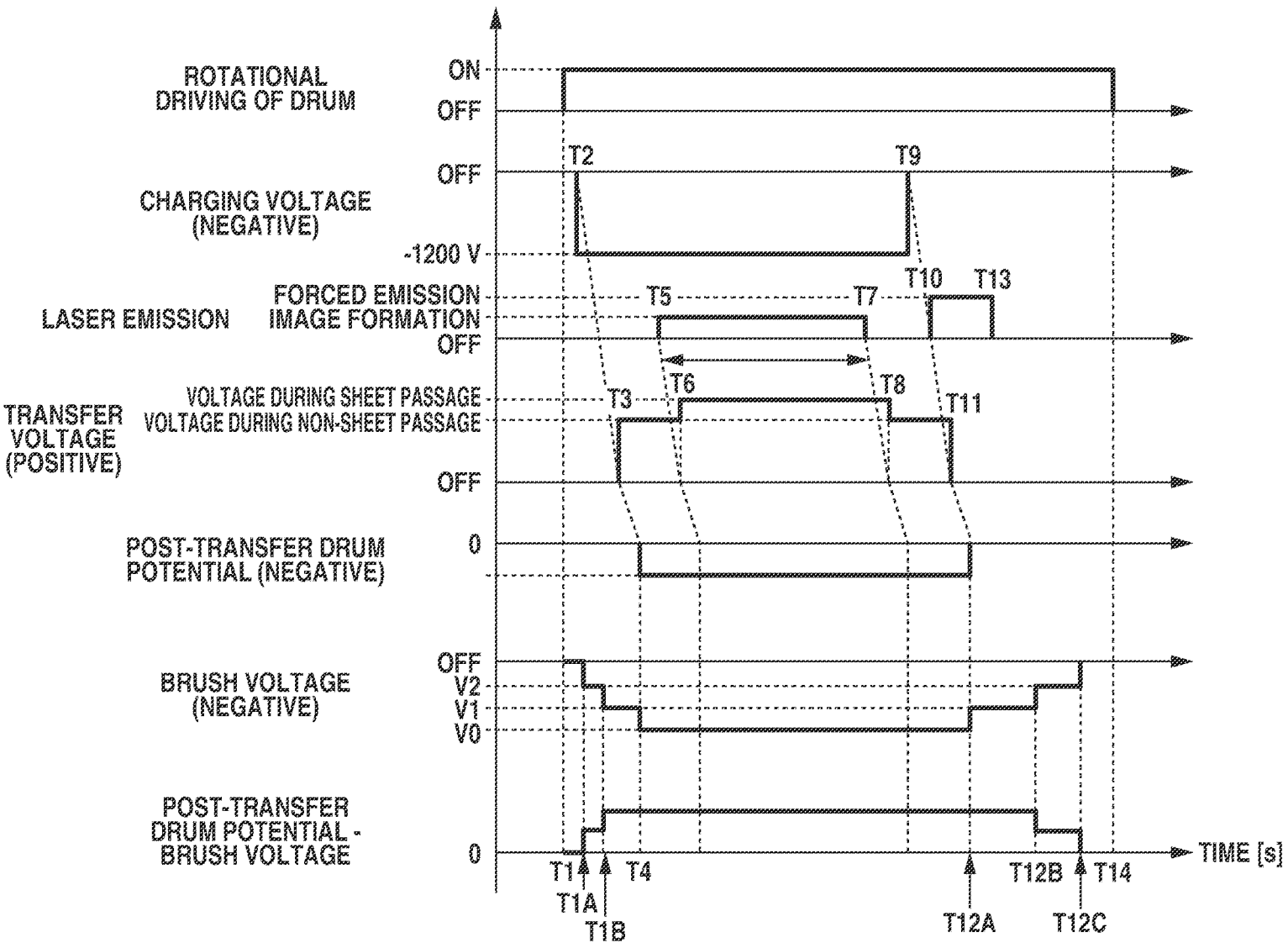
FIG. 12 is a diagram for describing control according to a fifth exemplary embodiment.

Next, control of various potentials according to the fifth exemplary embodiment will be described with reference to FIG. 12. FIG. 12 is a diagram illustrating the control of a single print job operation by the image forming apparatus 100 according to the fifth exemplary embodiment. The control is similar to that of the first exemplary embodiment from time T3 when the image forming operation is started to time T14 when the rotational driving of the photosensitive drum 1 is stopped. In the fifth exemplary embodiment, the brush voltage is increased stepwise from off to V2 to V1 to V0 between times T1 and T4, and then the image forming operation is started.

Next, the effect of the rotating operation of the photosensitive drum 1 on change in the orientation of the brush member 10 when the control of the fifth exemplary embodiment is performed up to time T3 will be described with reference to FIGS. 6A to 6C.

In the fifth exemplary embodiment, the brush voltage is not applied when the photosensitive drum 1 starts to be driven. With no electrostatic attractive force occurring between the brush member 10 and the surface of the photosensitive drum 1, the orientation of the brush member 10 when the photosensitive drum 1 starts to be driven changes from that of FIG. 6A to that of FIG. 6B. The brush voltage is then switched stepwise to V2, V1, and V0 at times T1A, T1B, and T4, in which process the orientation of the brush member 10 changes from that of FIG. 6B to that of FIG. 6C.

If the brush voltage is switched to V0 when the photosensitive drum 1 starts to be driven, the orientation of the brush member 10 changes abruptly and drastically from that of FIG. 6A to that of FIG. 6C. Controlling the brush voltage according to the fifth exemplary embodiment can thus make the change in the orientation of the brush member 10 milder.

In view of the foregoing, Table 4 shows a result of comparison between the result of a sheet passage test conducted in a similar manner to that in the first exemplary embodiment while performing the control of the fifth exemplary embodiment and that of the first exemplary embodiment.

TABLE 4

| | Paper dust trappability Number of blots (≥0.8 mm) |
|---|---|
| First exemplary embodiment | 10 |
| Fifth exemplary embodiment | 4 |

In comparison with the first exemplary embodiment, the number of blots is further reduced by the control execution of the fifth exemplary embodiment. One reason why the number of blots is reduced is that the paper dust aggregate in the brush member 10 becomes less likely to disintegrate because of the execution of the brush voltage control in starting to rotate the photosensitive drum 1 according to the fifth exemplary embodiment in addition to the brush voltage control in stopping rotating the photosensitive drum 1 according to the first exemplary embodiment.

The thus reduced change in the orientation of the brush member 10 in rotating the photosensitive drum 1 allows the paper dust gathering in the brush member 10 to be more stably held using the control of the fifth exemplary embodiment.

In the fifth exemplary embodiment, no brush voltage is applied in starting the rotational driving of the photosensitive drum 1. However, the brush voltage V2 may be applied in starting the rotational driving of the photosensitive drum 1 as long as the electrostatic attractive force is sufficiently small to an extent that the change in the orientation is hardly affected.

In the fifth exemplary embodiment, the brush voltage is switched three times between the start of the rotational driving of the photosensitive drum 1 and the execution of the image forming operation. However, this is not restrictive. Switching the brush voltage at least once or more can be effective. The brush voltage may be switched more than three times.

In the fifth exemplary embodiment, brush voltages in the range of −500 V to 0 V can be applied. If, however, one voltage value alone can be applied because of reduced apparatus cost, the post-transfer surface potential of the photosensitive drum 1 may be changed stepwise. More specifically, the potential difference between the brush voltage and the post-transfer surface potential of the photosensitive drum 1 may be changed by changing the surface potential of the photosensitive drum 1 stepwise. For example, the post-transfer surface potential of the photosensitive drum 1 may be similarly controlled by combinations of the control of the charging voltage, that of the amount of laser exposure, and that of the transfer voltage. It will be understood that similar effects can also be obtained by changes in the potential difference between the brush voltage and the post-transfer surface potential of the photosensitive drum 1 stepwise as both the brush voltage and the surface potential are changed.

Figure 13:
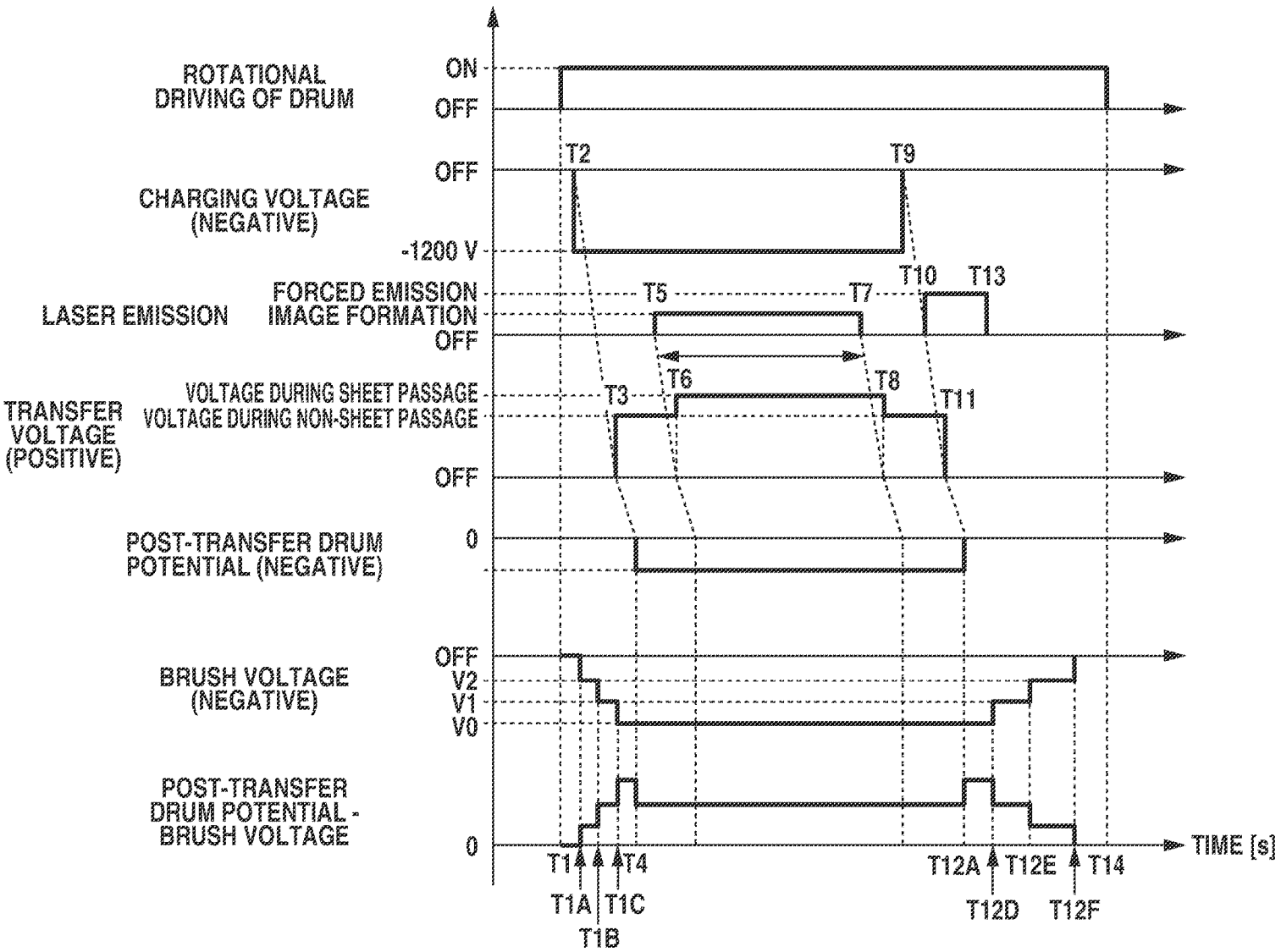
FIG. 13 is a diagram for describing control according to another exemplary embodiment.
Figure 14:
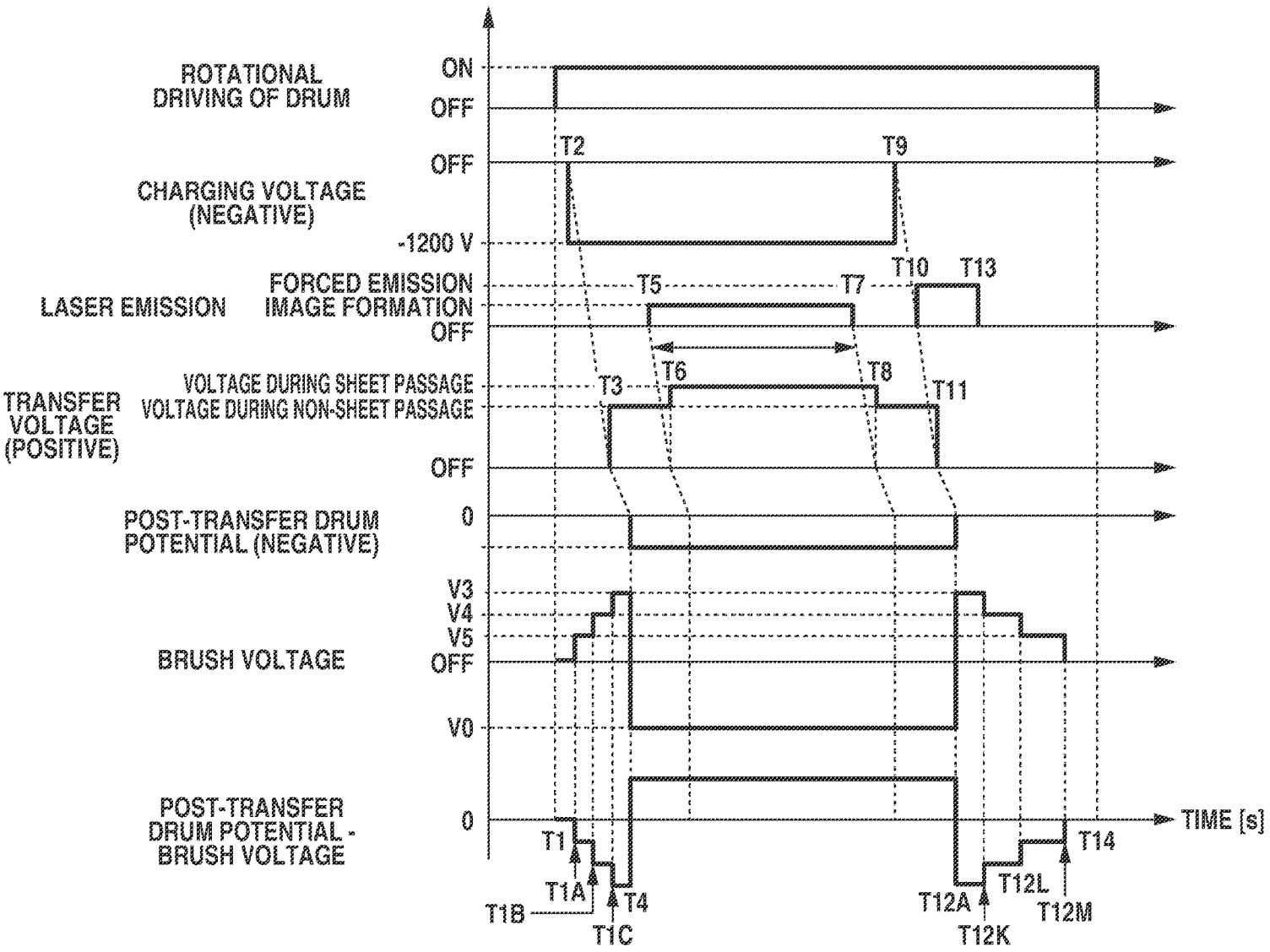
FIG. 14 is a diagram for describing control according to another exemplary embodiment.

In the fifth exemplary embodiment, the brush voltage is increased stepwise. It will be understood, however, that the brush voltage may be continuously increased in a reverse manner to the third exemplary embodiment. Moreover, the control in the rotation stop operation of the photosensitive drum 1 according to any of the first, second, third, and fourth exemplary embodiments and the control in the rotational driving of the photosensitive drum 1 according to the fifth exemplary embodiment may be implemented in combination. For example, as illustrated in FIG. 13, the second and fifth exemplary embodiments may be implemented in combination. As illustrated in FIG. 14, the first, fourth, and fifth exemplary embodiments may be implemented in combination. It will be understood that the execution of control such as illustrated in FIGS. 13 and 14 provides even higher effects. In FIG. 14, brush voltages V3, V4, and V5 in the pre-rotation operation are the same as those in the post-rotation operation. However, the brush voltages may be different between the pre- and post-rotation operations. The polarity of the brush voltage may be reversed depending on the normal polarity of the toner.

As described above, according to an exemplary embodiment of the present disclosure, paper dust gathering in a brush due to sheet passage can be stably held, which reduces image defects caused by the paper dust.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-027931, filed Feb. 24, 2021, which is hereby incorporated by reference herein in its entirety.

What is claimed is:

1. An image forming apparatus comprising:

a rotatable image bearing member;

a driving unit configured to drive the image bearing member to rotate;

a charging member configured to charge a surface of the image bearing member at a charging portion where the charging member is opposed to the image bearing member;

an exposure unit configured to expose the surface of the image bearing member charged by the charging member to form an electrostatic latent image on the surface of the image bearing member;

a developing member configured to develop the electrostatic latent image into a developer image by supplying a developer charged to a normal polarity to the surface of the image bearing member;

a transfer member configured to be in contact with the image bearing member to form a transfer portion and transfer the developer image from the surface of the image bearing member to a transfer material at the transfer portion;

a brush member configured to form a contact portion downstream of the transfer portion and upstream of the charging portion in a rotation direction of the image bearing member and be in contact with the surface of the image bearing member at the contact portion; and a control unit configured to control the driving unit, wherein the developing member is configured to, after the developer image formed on the surface of the image bearing member is transferred to the transfer material at the transfer portion, collect the developer remaining on the surface of the image bearing member, and wherein the control unit is configured to control the driving unit so that a driving state in which the image bearing member is driven with a first potential difference formed between the brush member and the image bearing member at the contact portion transitions to a stopped state where the image bearing member stops being driven with a second potential difference formed at the contact portion, the second potential difference having a same polarity as the first potential difference and an absolute value less than the absolute value of the first potential difference.

2. The image forming apparatus according to claim 1, wherein the control unit is configured to control the potential difference formed at the contact portion to change from the first potential difference to a third potential difference with the same polarity and from the third potential difference to the second potential difference, the absolute value of the third potential difference being less than the absolute value of the first potential difference and greater than the absolute value of the second potential difference.

3. The image forming apparatus according to claim 1, wherein the control unit is configured to control the potential difference formed at the contact portion to change from the first potential difference to the second potential difference stepwise.

4. The image forming apparatus according to claim 1, wherein the control unit is configured to control the potential difference formed at the contact portion to change from the first potential difference to the second potential difference continuously.

5. The image forming apparatus according to claim 1, further comprising a brush voltage application unit configured to apply a brush voltage to the brush member, wherein the control unit is configured to control formation of the first potential difference and the second potential difference by controlling the brush voltage applied by the brush voltage application unit.

6. The image forming apparatus according to claim 1, further comprising a charging voltage application unit configured to apply a charging voltage to the charging member, wherein the control unit is configured to control the charging voltage application unit to form the first potential difference and the second potential difference at the contact portion by controlling a surface potential of the image bearing member.

7. The image forming apparatus according to claim 1, further comprising a transfer voltage application unit configured to apply a transfer voltage to the transfer member, wherein the control unit is configured to control the transfer voltage application unit to form the first potential difference and the second potential difference at the contact portion by controlling a surface potential of the image bearing member.

8. The image forming apparatus according to claim 1, wherein the control unit is configured to control the exposure unit to form the first potential difference and the second potential difference at the contact portion by controlling a surface potential of the image bearing member.

9. The image forming apparatus according to claim 1, wherein the control unit is configured to control the potential difference formed at the contact portion to change from the first potential difference to a fourth potential difference of the same polarity and from the fourth potential difference to the second potential difference, the absolute value of the fourth potential difference being a potential difference greater than the absolute value the second potential difference.

10. The image forming apparatus according to claim 1, wherein the control unit is configured to control execution of an image forming operation for forming an image on the transfer material with the second potential difference formed.

11. The image forming apparatus according to claim 1, wherein the brush member is a paper dust removal member.

12. The image forming apparatus according to claim 1, wherein the developer is a one-component developer.

13. The image forming apparatus according to claim 1, wherein the charging member is in contact with the image bearing member at the charging portion.

14. The image forming apparatus according to claim 1, wherein the brush has a base fabric and a yarn portion including a plurality of yarns extending from the base fabric, and wherein a density of the yarn portion is equal to or more than 150 kF/inch$^2$.

15. An image forming apparatus comprising:

a rotatable image bearing member;

a driving unit configured to drive the image bearing member to rotate;

a charging member configured to charge a surface of the image bearing member at a charging portion where the charging member is opposed to the image bearing member;

an exposure unit configured to expose the surface of the image bearing member charged by the charging member to form an electrostatic latent image on the surface of the image bearing member;

a developing member configured to develop the electrostatic latent image into a developer image by supplying a developer charged to a normal polarity to the surface of the image bearing member;

a transfer member configured to be in contact with the image bearing member to form a transfer portion and transfer the developer image from the surface of the image bearing member to a transfer material at the transfer portion;

a brush member configured to form a contact portion downstream of the transfer portion and upstream of the charging portion in a rotation direction of the image bearing member and be in contact with the surface of the image bearing member at the contact portion; and a control unit configured to control the driving unit, wherein the developing member is configured to, after the developer image formed on the surface of the image bearing member is transferred to the transfer material at the transfer portion, collect the developer remaining on the surface of the image bearing member, and wherein the control unit is configured to control the driving unit so that a stopped state where the image bearing member is stopped with a first potential difference formed between the brush member and the image bearing member at the contact portion transitions to a driving state where the image bearing member is driven with a second potential difference formed at the contact portion, the second potential difference having an absolute value greater than the absolute value of the first potential difference.

16. The image forming apparatus according to claim 15, wherein the control unit is configured to control the potential difference formed at the contact portion to change from the first potential difference to a third potential difference with the same polarity and from the third potential difference to the second potential difference, the absolute value of the third potential difference being less than the absolute value of the first potential difference and greater than the absolute value of the second potential difference.

17. The image forming apparatus according to claim 15, wherein the control unit is configured to control the potential difference formed at the contact portion to change from the first potential difference to the second potential difference stepwise.

18. The image forming apparatus according to claim 15, wherein the control unit is configured to control the potential difference formed at the contact portion to change from the first potential difference to the second potential difference continuously.

19. The image forming apparatus according to claim 15, further comprising a brush voltage application unit configured to apply a brush voltage to the brush member, wherein the control unit is configured to control formation of the first potential difference and the second potential difference by controlling the brush voltage applied by the brush voltage application unit.

20. The image forming apparatus according to claim 15, further comprising a charging voltage application unit configured to apply a charging voltage to the charging member, wherein the control unit is configured to control the charging voltage application unit to form the first potential difference and the second potential difference at the contact portion by controlling a surface potential of the image bearing member.

21. The image forming apparatus according to claim 15, further comprising a transfer voltage application unit configured to apply a transfer voltage to the transfer member, wherein the control unit is configured to control the transfer voltage application unit to form the first potential difference and the second potential difference at the contact portion by controlling a surface potential of the image bearing member.

22. The image forming apparatus according to claim 15, wherein the control unit is configured to control the exposure unit to form the first potential difference and the second potential difference at the contact portion by controlling a surface potential of the image bearing member.

23. The image forming apparatus according to claim 15, wherein the control unit is configured to control execution of an image forming operation for forming an image on the transfer material with the second potential difference formed.

24. The image forming apparatus according to claim 15, wherein the brush member is a paper dust removal member.

25. The image forming apparatus according to claim 15, wherein the developer is a one-component developer.

26. The image forming apparatus according to claim 15, wherein the charging member is in contact with the image bearing member at the charging portion.

27. The image forming apparatus according to claim 15, wherein the brush has a base fabric and a yarn portion including a plurality of yarns extending from the base fabric, and wherein a density of the yarn portion is equal to or more than 150 kF/inch$^2$.

* * * * *